US011710362B2

(12) United States Patent
Grzenda et al.

(10) Patent No.: US 11,710,362 B2
(45) **Date of Patent: *Jul. 25, 2023**

(54) SYSTEMS AND METHODS FOR CONTROLLING ACCESS TO A SECURED SPACE

(71) Applicant: Konnex Enterprises Inc., Ancaster (CA)

(72) Inventors: Jeanne Grzenda, Ancaster (CA); Timothy Kyowski, Kitchener (CA); Steven Fyke, Waterloo (CA); Jason T. Griffin, Kitchener (CA)

(73) Assignee: Konnex Enterprises Inc., Ancaster (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/362,266

(22) Filed: Jun. 29, 2021

(65) Prior Publication Data

US 2021/0398376 A1 Dec. 23, 2021

Related U.S. Application Data

(63) Continuation of application No. 17/025,489, filed on Sep. 18, 2020, now Pat. No. 11,049,345, which is a (Continued)

(51) Int. Cl.

| | |
|---|---|
| ***G07C 9/22*** | (2020.01) |
| ***G07C 9/00*** | (2020.01) |
| ***G07C 9/27*** | (2020.01) |

(52) U.S. Cl.

CPC ..... *G07C 9/22* (2020.01); *G07C 9/00309* (2013.01); *G07C 9/00571* (2013.01); (Continued)

(58) Field of Classification Search

None

See application file for complete search history.

(56) References Cited

U.S. PATENT DOCUMENTS

| | | |
|---|---|---|
| 8,789,859 B2 | 7/2014 | Curtis et al. |
| 9,365,188 B1 | 6/2016 | Penilla et al. |

(Continued)

FOREIGN PATENT DOCUMENTS

| | | |
|---|---|---|
| CA | 2658729 A1 | 9/2009 |
| CA | 2828270 A1 | 9/2012 |

(Continued)

OTHER PUBLICATIONS

International Search Report and Written Opinion dated Apr. 26, 2019 in related International Patent Application No. PCT/CA2019/050067 (21 pages).

*Primary Examiner* — Adolf Dsouza

(74) *Attorney, Agent, or Firm* — Bereskin & Parr LLP

(57) ABSTRACT

Systems and methods for controlling access to a secured space are disclosed. The system includes a locking device having a body having a rotatable locking cam having a locked paddle and an unlocked paddle. The cam is rotatable between a first position and a second position. The body also has a locking pin and a power supply for supplying electrical power to circuit components of the locking device. The locking device also includes a shackle having two arms. One of the two arms has a groove in a bottom portion thereof configured to engage with the locking pin when the shackle is in a closed position. In the first position, the locked paddle of the rotatable locking cam engages the locking pin in the groove. In the second position, the locked paddle of the rotatable locking cam is disengaged from the locking pin.

10 Claims, 18 Drawing Sheets

Related U.S. Application Data continuation of application No. 16/251,314, filed on Jan. 18, 2019, now Pat. No. 10,818,117.

(60) Provisional application No. 62/756,789, filed on Nov. 7, 2018, provisional application No. 62/619,211, filed on Jan. 19, 2018.

(52) U.S. Cl.
CPC ..... *G07C 9/00817* (2013.01); *G07C 9/00912* (2013.01); *G07C 9/27* (2020.01); *G07C 2009/00373* (2013.01); *G07C 2009/00507* (2013.01); *G07C 2009/00793* (2013.01); *G07C 2009/00825* (2013.01)

(56) References Cited

U.S. PATENT DOCUMENTS

| | | | |
|---|---|---|---|
| 9,646,165 | B1 | 5/2017 | Saylor |
| 9,679,429 | B2 | 6/2017 | Duncan et al. |
| 9,728,022 | B2 | 8/2017 | Gengler et al. |
| 9,747,739 | B2 | 8/2017 | Gengler et al. |
| 9,810,000 | B2 | 11/2017 | Schroeder |
| 9,860,677 | B1 | 1/2018 | Agerstam et al. |
| 11,145,016 | B1 | 10/2021 | Brophy |
| 2003/0208386 | A1 | 11/2003 | Brondrup |
| 2012/0011902 | A1* | 1/2012 | Meekma ..... E05B 47/0012 70/52 |
| 2013/0086956 | A1 | 4/2013 | Nave |
| 2016/0217637 | A1 | 7/2016 | Gengler et al. |
| 2016/0292943 | A1 | 10/2016 | Ranchod |
| 2016/0307380 | A1 | 10/2016 | Ho et al. |
| 2017/0063566 | A1 | 3/2017 | Seminario et al. |
| 2017/0076520 | A1 | 3/2017 | Ho |
| 2017/0154483 | A1 | 6/2017 | Cordiner et al. |
| 2017/0236343 | A1 | 8/2017 | Leboeuf |
| 2017/0067271 | A1 | 11/2017 | Schroeder |
| 2018/0018841 | A1 | 1/2018 | Gengler et al. |
| 2018/0018843 | A1 | 1/2018 | Gengler et al. |
| 2018/0023322 | A1 | 1/2018 | Curtis et al. |
| 2018/0075679 | A1 | 3/2018 | Niroomand |

FOREIGN PATENT DOCUMENTS

| | | | |
|---|---|---|---|
| CN | 105590361 | A | 5/2016 |
| EP | 243461 | A1 | 11/1987 |
| WO | 2012034171 | A1 | 3/2012 |
| WO | 2016131416 | A1 | 8/2016 |
| WO | 2017044599 | A1 | 3/2017 |

* cited by examiner

SYSTEMS AND METHODS FOR CONTROLLING ACCESS TO A SECURED SPACE

RELATED APPLICATIONS

This application is a continuation application of U.S. patent application Ser. No. 17/025,489 filed Sep. 18, 2020, which is a continuation application of U.S. patent application Ser. No. 16/251,314, filed Jan. 18, 2019, which claims the benefit of U.S. Provisional Patent Application No. 62/619,211, filed Jan. 19, 2018 and U.S. Provisional Patent Application No. 62/756,789, filed Nov. 7, 2018, all of which are incorporated herein by reference in their entirety.

FIELD

The described embodiments relate to physical security and in particular, to systems and methods of providing controlling access to a secured space.

BACKGROUND

Self-storage facilities rent space to tenants for storage of goods. Tenants may be individuals who would like to store household goods. Tenants may also be businesses who require space to store inventory, tools, parts, supplies, or records. Furthermore, some self-storage facilities offer climate controlled environments, which allow businesses to readily store sensitive goods (i.e., pharmaceuticals and electronics) without the overhead expenses involved in establishing and maintaining such a climate controlled environment.

Self-storage units can be secured by a locking device. The locking device can be provided by the tenant and personnel of the facility may not have access to the self-storage unit. In other cases, the locking device can be provided by the facility and the facility can have a master key to unlock the locking device if needed. Locking devices can be locked and/or unlocked with physical keys including traditional physical keys, key fobs, and key cards, digital keys including passwords and key codes, or biometric data. The facility can also have additional security measures such as locked doors and gateways for areas within and around the facility to ensure that only authorized personnel have access to those areas of the facility.

SUMMARY

The various embodiments described herein generally relate to methods (and associated systems configured to implement the methods) for controlling access to a secured space. The method includes providing at least one communication network and a server and fastening a locking device to an access point of the secured space. The server can include a server processing unit, a server storage unit, and at least one communication interface operable to communicate with at least one user computing device via the at least one communication network. The locking device can include an actuator, a lock processing unit, a lock memory, and at least one lock communication interface. The actuator can move the locking device into a locked state to maintain the access point closed or an unlocked state to allow the access point to be opened. The at least one lock communication interface is operable to communicate with the server via the at least one communication network. The method further includes storing authorization data for the locking device on the server storage unit and configuring each of the server processing unit and the lock processing unit. The server processing unit can be configured to receive a security request for the locking device from a user computing device; determine whether the security request includes requesting data that corresponds to the authorization data stored for the locking device; in response to determining that the requesting data corresponds to the authorization data stored for the locking device, generate a security command based on the security request; and communicate the security command to the locking device. The lock processing unit can be configured to generate a control signal for the actuator based at least in part on the security command.

In another broad aspect, a system for controlling access to a secured space is disclosed. The system includes at least one communication network; a locking device fastenable to an access point of the secured space; and a server. The locking device includes an actuator, a lock processing unit, a lock memory, and at least one lock communication interface. The actuator can move the locking device into a locked state to maintain the access point closed or an unlocked state to allow the access point to be opened. The lock processing unit is operable to generate a control signal for the actuator. The at least one lock communication interface is operable to communicate via the at least one communication network. The server includes a server storage unit to store authorization data for the locking device; at least one server communication interface operable to communicate with the locking device and at least one user computing device via the at least one communication network; and a server processing unit. The server processing unit is operable to: receive a security request for the locking device from a user computing device; determine whether the security request comprises requesting data that corresponds to the authorization data stored for the locking device; in response to determining that the requesting data corresponds to the authorization data stored for the locking device, generate a security command based on the security request; and communicate the security command to the locking device. The control signal for the actuator is generated based at least in part on the security command.

In some aspects, the security request can include either an access request or a lock request.

In some aspects, the security command can include either an unlock command or a lock command. Upon receipt of an unlock command, the control signal generated by the lock processing unit can include a signal to move the locking device into the unlocked state. Upon receipt of a lock command, the control signal generated by the lock processing unit can include a signal to move the locking device into the locked state.

In some aspects, the control signal generated by the lock processing unit can include a signal to move the locking device into the locked state when the locking device is closed.

In some aspects, the locking device further includes a timer. The timer can be configured to initiate when the locking device enters the unlocked state, to terminate when the locking device is opened, and to expire after a predetermined period of time that the locking device remains closed after it enters that instance of the unlocked state. The control signal generated by the lock processing unit can be a signal to move the locking device into the locked state when the timer expires.

In some aspects, the lock processing unit is operable for transmitting an operating state of the locking device to the server.

In some aspects, the system can include at least one power supply for supplying electrical power to circuit components of the locking device via a wired connection.

In some aspects, the locking device can include an electrical energy storage unit for supplying electrical power to circuit components of the locking device.

In some aspects, the locking device can remain in a current state when power is not supplied to circuit components of the locking device. The current state can be either the locked state or the unlocked state immediately prior to power being disconnected from the circuit components.

In some aspects, the lock processing unit can be operable in one of a regular power mode and a low power mode. The locking device can further include a user input device for switching the lock processing unit from the low power mode to the regular power mode.

In some aspects, the user input device can be a switch.

In some aspects, the user input device can be a motion detector.

In some aspects, the locking device can further include a physical key and the control signal generated by the lock processing unit can be a signal to move the locking device into the unlocked state when the physical key is presented at the locking device.

In some aspects, the locking device is removably fastenable to the access point of the secured space.

In some aspects, the at least one communication network can include a first communication network for communication between the locking device and the server and a second communication network for communication between the user computing device and the server.

In some aspects, at least one of the server processing unit and the lock processing unit is further operable for determining whether the user computing device is proximal to the secured space.

In some aspects, the authorization data can include at least one of a user identification, a secured space status, and an authorization token.

In some aspects, the system further includes at least one sensor unit operable for collecting monitoring data of the secured space.

In some aspects, the at least one sensor unit is further operable for communicating the monitoring data to the server.

In some aspects, the monitoring data includes at least one of an open state of the access point, a closed state of the access point, image data of the secured space, motion data of the secured space, lighting data of the secured space, and heat data of the secured space.

In another broad aspect, a locking device is disclosed. The locking device includes a body and a shackle. The body includes a rotatable locking cam having a locked paddle and an unlocked paddle, the cam being rotatable between a first position and a second position; a locking pin having a magnetic core; and a power supply for supplying electrical power to circuit components of the locking device. The shackle has two arms insertable into the body, one of the two arms having a recess in a bottom portion thereof configured to engage with the locking pin, the shackle configured to move between an open position and a closed position, the closed position allowing either the locked paddle to drive the locking pin to engage the recess or the unlocked paddle to engage the locking pin.

In some aspects, the rotatable cam further includes a locking magnet having a north-south pole to repel the locking pin and drive the locking pin to engage the recess of the shackle when the rotatable cam moves from the first position and the second position.

In some aspects, the rotatable cam further includes an unlocking magnet having a north-south pole to attract the locking pin and attract the locking pin to disengage the recess of the shackle when the rotatable cam moves from the first position and the second position.

In some aspects, each of the unlocked paddle and the locked paddle extend from the rotatable locking cam towards a same arm of the shackle.

In some aspects, the locked paddle is positioned vertically above the unlocked paddle.

In some aspects, the rotatable locking cam is configured to rotate in a first direction to move the locking device from a locked state to an unlocked state.

In some aspects, the first direction is a counterclockwise direction.

In some aspects, the rotatable locking cam is configured to rotate in a second direction to move the locking device from an unlocked state to a locked state.

In some aspects, the second direction is a clockwise direction.

In another broad aspect, another locking device is disclosed. The locking device includes a body and a shackle. The body includes a rotatable locking cam having a locked paddle and an unlocked paddle, the cam being rotatable between a first position and a second position; a locking pin; a torsion spring configured to bias the locking pin; and a power supply for supplying electrical power to circuit components of the locking device. The shackle has two arms insertable into the body, one of the two arms having a recess in a bottom portion thereof configured to engage with the locking pin, the shackle configured to move between an open position and a closed position, the closed position allowing either the locked paddle to drive the locking pin to engage the recess or the unlocked paddle to engage the locking pin.

In some aspects, the torsion spring biases the locking pin to disengage with the recess of the shackle upon rotation of the locking cam.

BRIEF DESCRIPTION OF THE DRAWINGS

Several embodiments will now be described in detail with reference to the drawings, in which.

Figure 1A:
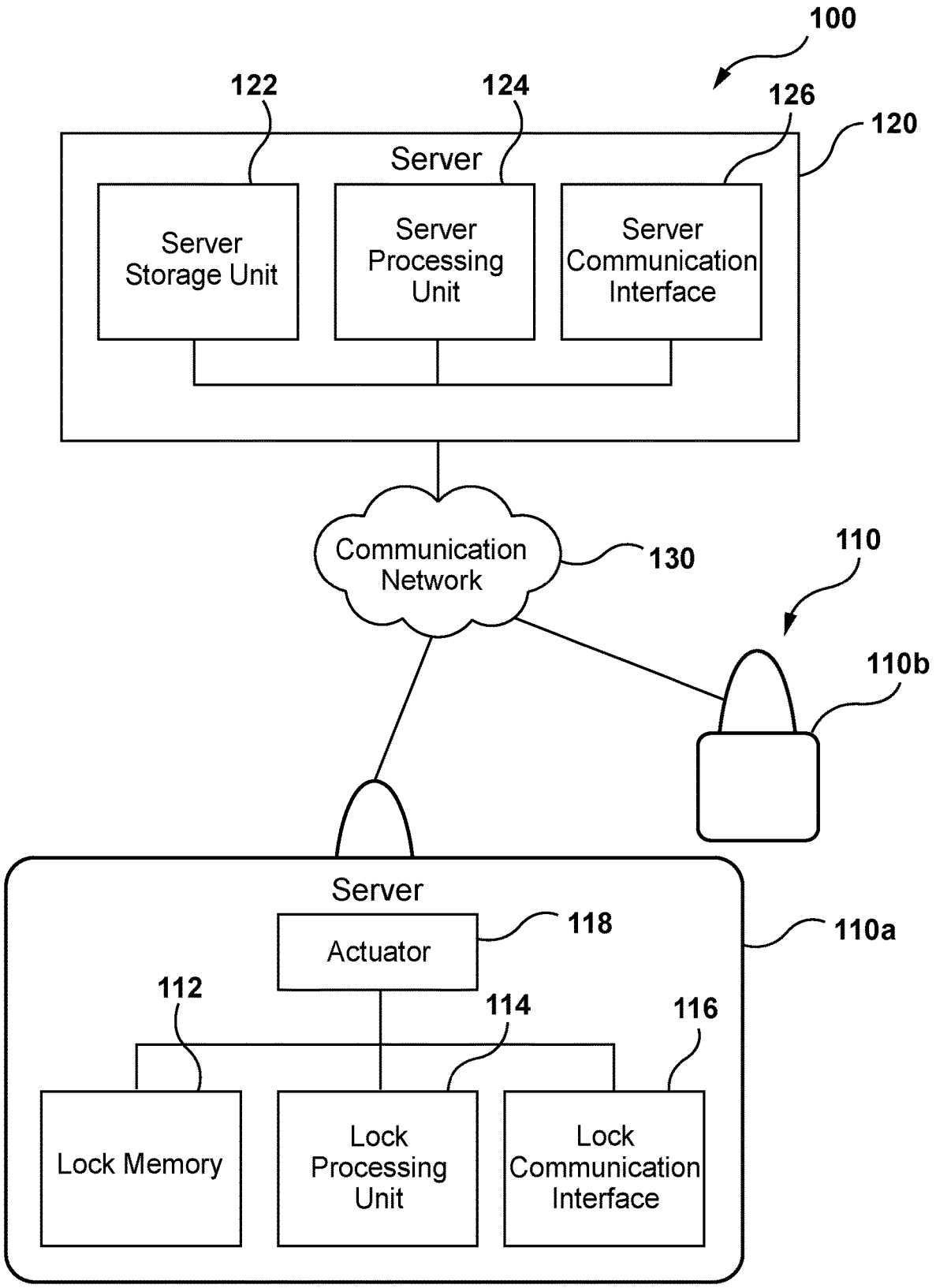
FIG. 1A is a diagram of a system for controlling access to a secured space, according to at least one embodiment.

The drawings, described below, are provided for purposes of illustration, and not of limitation, of the aspects and features of various examples of embodiments described herein. For simplicity and clarity of illustration, elements shown in the drawings have not necessarily been drawn to scale. The dimensions of some of the elements may be exaggerated relative to other elements for clarity. It will be appreciated that for simplicity and clarity of illustration, where considered appropriate, reference numerals may be repeated among the drawings to indicate corresponding or analogous elements or steps.

DESCRIPTION OF EXAMPLE EMBODIMENTS

The various embodiments described herein generally relate to methods (and associated systems configured to implement the methods) for control access to a secured space. The term "secured space", as used herein, broadly refers to any physical space or unit of a central manager and designated for use by authorized users and to which access by unauthorized users is prevented by a locking device.

For example, the secured space can be a self-storage unit within a self-storage facility. In other embodiments, the secured space can be multiple individual units of physical space that share a centralized management system and each individual unit is accessible to different users. For example, the secured space can be lockers, rooms, or containers, equipment locks (e.g., bikes, skis, golf clubs) located within an apartment building, condominium, office space, transit hub (e.g., airports, train stations, bus stations), hotel, resort, school, campus, recreation center, community center, library, or hospital.

As can be seen from these examples of secured space, the duration that a user is authorized by the central manager can be limited. Self-storage units are typically rented on a monthly basis. Other forms of secured space can also be used for shorter or longer durations. For example, equipment locks may be rented on a daily basis.

A user, or a tenant of a secure space may want to allow someone else to access their secured space. A locking device requiring biometric data cannot be easily unlocked by other individuals. That is, the ability to unlock the device cannot be transferred amongst individuals.

A locking device requiring a physical key can be convenient as anyone in possession of the physical key can gain unlock the device. However, physical keys must be physically transferred between individuals. In addition, physical keys can be lost, stolen, and in some cases, replicated. Physical keys do not offer traceability in respect of identifying who has used the physical key.

The term "physical key", as used herein, broadly refers to any physical object that a locking device requires presentation of in order to transition to/from a locked state and an unlocked state. A physical key can include, but is not limited to, traditional physical keys, key fobs, and key cards, including barcodes, magnetic stripes, microchips, and/or radio frequency identification devices.

A locking device requiring a digital key can be convenient as anyone in possession of the digital key can gain unlock the device. However, once a digital key is shared, the ability to unlock the device can only be revoked by changing the password or key code.

In addition, in some cases, the central manager may need to unilaterally take control of a secured space. In the case of a self-storage unit, the self-storage facility may need to block access to a self-storage unit or evict a tenant for failure to pay rental fees or other violations of a rental agreement. For example, rental agreements typically prohibit self-storage units from being used as a place of residence.

To block access to a self-storage unit, an overlock can be installed on the self-storage unit. An overlock involves placing an extra lock on the locking device to prevent the locking device from allow access to the authorized user. When a self-storage facility evicts a tenant, the self-storage facility may vacate the tenant's contents, including selling the tenant's contents.

Care must be taken to ensure that such unilateral actions are being taken against the correct self-storage unit. Multiple individual units can look identical and identification of individual units can be subtle. Evicting the wrong unit will typically require compensation to the innocent tenant, thus resulting in financial losses for the central manager.

The central manager may rely on employees or other individuals to carry out such actions against a secured space. However, whether for innocent reasons or for other motives, such individuals may not strictly adhere to the central manager's instructions. For example, an employee may provide a tenant access to the secured space after an overlock has been installed. The employee may be convinced by the tenant that the overlock was placed in error. Alternatively, the employee may be financially induced by the tenant. In any event, such actions may not align with the objectives of the central manager.

It will be appreciated that numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description and the drawings are not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that the term "coupled" used herein indicates that two elements can be directly coupled to one another or coupled to one another through one or more intermediate elements.

The embodiments of the systems and methods described herein may be implemented in hardware or software, or a combination of both. These embodiments may be implemented in computer programs executing on programmable computers, each computer including at least one processor, a data storage system (including volatile memory or non-volatile memory or other data storage elements or a combination thereof), and at least one communication interface. For example and without limitation, the programmable computers may be a server, network appliance, embedded device, computer expansion module, a personal computer, laptop, personal data assistant, cellular telephone, smartphone device, tablet computer, a wireless device or any other computing device capable of being configured to carry out the methods described herein.

In some embodiments, the communication interface may be a network communication interface. In embodiments in which elements are combined, the communication interface may be a software communication interface, such as those for inter-process communication (IPC). In still other embodiments, there may be a combination of communication interfaces implemented as hardware, software, and combination thereof.

Program code may be applied to input data to perform the functions described herein and to generate output information. The output information is applied to one or more output devices, in known fashion.

Each program may be implemented in a high level procedural or object oriented programming and/or scripting language, or both, to communicate with a computer system. However, the programs may be implemented in assembly or machine language, if desired. In any case, the language may be a compiled or interpreted language. Each such computer program may be stored on a storage media or a device (e.g. ROM, magnetic disk, optical disc) readable by a general or special purpose programmable computer, for configuring and operating the computer when the storage media or device is read by the computer to perform the procedures described herein. Embodiments of the system may also be considered to be implemented as a non-transitory computer-readable storage medium, configured with a computer program, where the storage medium so configured causes a computer to operate in a specific and predefined manner to perform the functions described herein.

Furthermore, the system, processes and methods of the described embodiments are capable of being distributed in a computer program product comprising a computer readable medium that bears computer usable instructions for one or more processors. The medium may be provided in various forms, including one or more diskettes, compact disks, tapes, chips, wireline transmissions, satellite transmissions, internet transmission or downloadings, magnetic and electronic storage media, digital and analog signals, and the like. The computer useable instructions may also be in various forms, including compiled and non-compiled code.

Figure 1B:
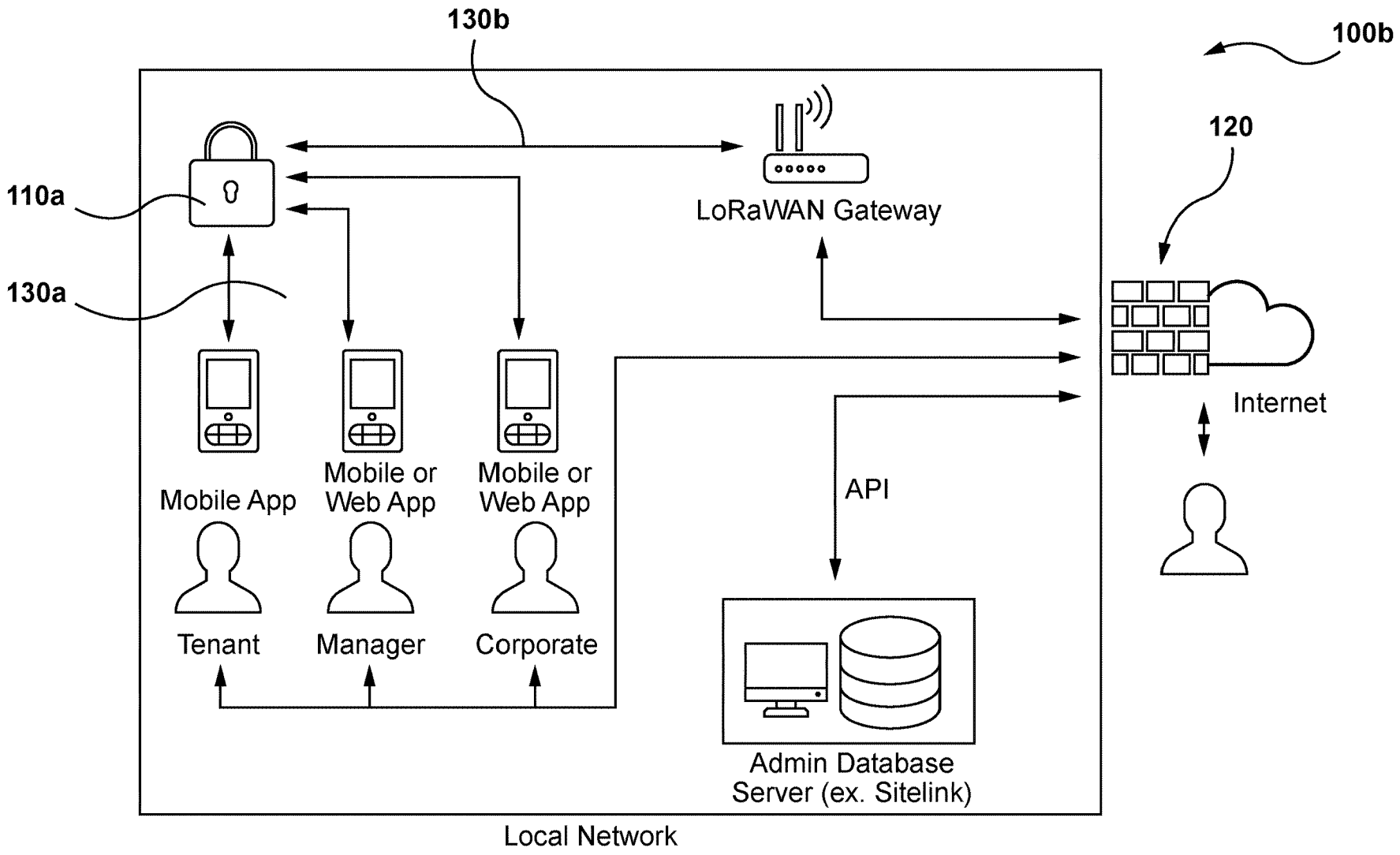
FIG. 1B is a diagram of a system for controlling access to a secured space, according to at least another embodiment.

Referring to FIG. 1, there is shown a diagram of a system 100 for controlling access to a secured space, according to at least one embodiment. The system 100 can include one or more locking devices 110 for one or more secured spaces, a server 120, and a communication network 130. Although only two locking devices 110*a* and 110*b* are shown in FIG. 1, it is possible for the system 100 to include fewer or more locking devices 110.

Furthermore, access to a secured space can be controlled by one or more locking devices 110. For example, a first locking device 110*a* can provide access to the site or the facility; a second locking device 110*b* can provide access to a particular floor of the facility; and a third locking device 110 can provide access to an individual unit on that floor of the facility.

The locking device 110 can secure access to a physical space at an access point. The term "access point", as used herein, broadly refers to an entrance of a secured space that has an open state for permitting access to the secured space from the access point and a closed state for preventing access to the secured space from the access point. An access point can be a door, a gate, a fence, two adjacent pieces of housing, or any other type of enclosure.

The locking device 110 can include a shackle for engaging with, or fastening to, a clasp on an access point of the physical space to keep the access point closed. The access point can be opened by disengaging the shackle from the clasp on the access point. In other embodiments, the locking device 110 may be directly fastened to the access point.

As shown in FIG. 1, the locking device 110*a* can include a locking processing unit 114, a lock memory (or storage unit) 112, a lock communication interface 116, and an actuator 118. The locking processing unit 114 facilitates the operation of the actuator 118 by providing a control signal for the actuator 118. The locking processing unit 114 can include any suitable processors, controllers or digital signal processors that can provide sufficient processing power depending on the configuration, purposes and requirements of the locking device 110. In some embodiments, the locking processing unit 114 can include more than one processing unit with each processing unit being configured to perform different dedicated tasks.

The lock memory 112 can store data to be used during the operation of the locking device 110 and/or to facilitate the operation of the locking device 110. Example data can include identification data for the locking device 110. Identification data can represent a model or type of the locking device 110. The identification data can also represent an identifier for that particular locking device 110.

The lock memory 112 can also store operating data of the locking devices 110. Operating data can relate to an operating state of the locking devices 110, such as a locked state, an unlocked state, an open state, and a closed state. Operating data of the locking devices 110 can also relate to an operating mode of the locking devices 110 such as a regular power mode or a low power mode. Operating data can also relate to movement of the locking device 110, attempted openings of the locking device 110, and a state of charge of an electrical energy storage unit of the locking device 110, if provided. Operating data typically includes temporal information, such as the date and time of events such as the date and time of a transition between states and/or modes.

The lock communication interface 116 can include any component for facilitating communication with the other components of the system 100 via the communication network 130. For example, the lock communication interface 116 can include a wireless transceiver for communicating within a wireless communications network. The lock communication interface 116 can communicate identification data and/or operating data of the locking devices 110 to the communication network 130. The lock communication interface 116 can receive commands from the communication network 130.

The actuator 118 can receive a control signal from the lock processing unit 114. Based on the control signal, the actuator 118 can move the locking device 110 into the locked state or the unlocked state. When the locking device 110 is in the locked state, the shackle can remain engaged with the clasp on the access point to keep the access point closed. When the locking device 110 is in the unlocked state, the shackle can be disengaged from the clasp on the access point to allow the access point to be opened.

The lock processing unit 114 can receive a security command from the communication network 130 and generate a control signal for the actuator, based at least in part on the security command received from the communication network 130. For example, the security command received from the communication network 130 can be an unlock command or a lock command. An unlock command can be generated by the server 120. Generation of the unlock command can be triggered by a user at a user computing device (not shown in FIG. 1), such as a tenant or central manager, wishing to access the self-storage unit on which the locking device 110 is fastened to. Upon receipt of an unlock command, the lock processing unit 114 can generate a control signal for the actuator 118 to move the locking device 110 into the unlocked state. Once the locking device 110 is in the unlocked state, the locking device 110 can be disengaged, removed, or positioned in a manner to allow the access point to be opened.

Similarly, a lock command can be generated by the server 120 and generation of the unlock command can be triggered by a user at a user computing device, such as a tenant or central manager, wishing to secure the self-storage unit on which the locking device 110 fastenable to. Upon receipt of a lock command, the lock processing unit 114 can generate a control signal for the actuator 118 to move the locking device 110 into the locked state. The lock processing unit 114 can also automatically generate a control signal for the actuator 118 to move the locking device 110 into the locked state when the locking device 110 returns to the closed state after being in the open state. Once the locking device 110 is in the locked state, the locking device 110 cannot be disengaged, or positioned in a manner to allow the access point to be opened. That is, in the locked state, the locking device 110 remains engaged with the access point to keep it closed.

The determination of the locked state of the locking device 110 may not be limited to the state of the locking device 110 in itself. In some embodiments, the locked state can also depend on a location of the locking device 110 and the pattern, behavior, or sequence of events at the locking device 110. The location of the locking device 110 can be determined by a signal strength of the locking device 110 to the communication network 130.

In addition to receiving of a security command from the communication network 130, the lock processing unit 114 may require additional conditions to be met. For example, the locking device 110 can also include a switch and the lock processing unit 114 may require the switch to be manipulated in order to generate a control signal that causes the actuator 118 to move the locking device 110 into the unlocked state.

In another example, the locking device 110 can also require a password or a key code to be entered in order to generate a control signal that causes the actuator 118 to move the locking device 110 into the unlocked state. In some embodiments, the password or key code can be an alternative to the security command triggered by a user at a user computing device. This can be appropriate for example, when the locking device 110 provides access to a plurality of users, such as for a site, a facility, or an entire floor.

In yet another example, the locking device 110 can include a physical key mechanism and the presentation of the physical key can itself unlock the locking device 110 or be required in addition to the security command triggered by a user at a user computing device.

In addition, the lock processing unit 114 can transmit the status of the locking device to the server 120 via the communication network 130. In some embodiments such as but not limited to the alternative embodiment system **100*b* shown in FIG. 1B, the communication network 130 may include more than one communication network. For instance, the locking device 110 may receive a security command from a first communication network 130*a* such as but not limited to a Bluetooth® Low Energy network and may transmit a signal such as a signal indicating a status of the locking device 110 to the server 120 via a second communication network 130*b*. In the embodiment shown in FIG. 1**B, the second communication network is a LoRaWAN gateway communication network.

In some embodiments, the locking device 110 can include a timer (not shown in FIG. 1). The timer can be activated, or initiated, when the locking device 110 enters, or is transitioned to, an unlocked state. The timer can be configured to terminate when the locking device 110 in an open state, that is, when the locking device 110 is disengaged from the access point. The timer can be configured to expire after a pre-determined period of time that the locking device remains in a closed state, that is, when the locking device 110 remains engaged with the access point, after it enters that instance of the unlocked state. When the timer expires, the lock processing unit 114 can generate a control signal to move the locking device 110 into the locked state.

The locking device 110 can include with an electrical energy storage unit (not shown in FIG. 1) for supplying electrical power to circuit components of the locking device 110. Circuit components include the lock processing unit 114 and can include the actuator 118. The electrical energy storage unit can be a battery. The battery can be disposable or rechargeable. An electrical energy storage unit can be convenient as it can eliminate the need to run wires to each access point or each secured space.

In some embodiments, circuit components of the locking device 110 can be supplied with electrical power from a power supply via a wired connection. That is, electrical power can be supplied to the locking device 110 via a wired connection.

In some embodiments, the locking device 110 can remain in the same state when power is not supplied to circuit components of the locking device 110. That is, the locking device 110 can remain in the state immediately prior to power being disconnected from the circuit components. This can allow the electrical energy storage unit to be removed for maintenance when the locking device 110 is locked. The electrical energy storage unit can be removed and replaced, or temporarily removed for charging. The ability for the locking device 110 to remain locked without power to circuit components allows discharged electrical energy storage units to be managed on an as needed basis.

In some embodiments, the locking device 110 can operate in different modes, including a regular power mode and a low power mode to allow for an extended operating duration before recharging or replacement of the electrical energy storage unit. In the regular power mode, the locking device 110 may communicate operating data to the server 120 via the communication network 130. Such communication can occur on an event-basis. For example, the status of the locking device 110 can be transmitted when the locking device 110 transitions from the open state to the closed state. Such communication can also occur on a temporal basis. For example, the status of the locking device 110 can be transmitted on a regular schedule, such hourly.

In the low power mode, the locking device 110 may not communicate operating data to the communication network 130. In some embodiments, the locking device 110 can store the operating data in the lock memory 112 during the low power mode and then transmit the operating data to the communication network 130 in the next instance of the regular power mode.

In some embodiments, the locking device 110 in the low power mode can be switched into the regular power mode from distinct wakeup signals from the communication network 130. In some embodiments, the locking device 110 can include a sensor or a switch to receive user input for switching the locking device 110 from the low power mode to the regular power mode. For example, the sensor can detect motion representing user input, such as an accelerometer. When the locking device 110 includes a switch, the user input can also be used for switching the locking device 110 from the regular power mode to the low power mode.

In some embodiments, the locking device 110 can be switched into the regular power mode at pre-determined time intervals. That is, the locking device 110 can storing the operating data during the low power mode and wakeup (i.e., switching to the regular power mode) at predetermined time intervals to transmit the operating data to the communication network 130.

In at least one embodiment, the locking device 110 is padlock capable of wireless communication. A padlock can offer flexibility in being used in door systems of existing buildings. Furthermore, a padlock can be convenient as it can be interchangeable with other padlocks.

As shown in FIG. 1, the server 120 includes a server storage unit 122, a server processing unit 124, and a server communication interface 126. The server storage unit 122 can store data generated by the server processing unit and data received from the locking devices 110, user computing devices (not shown in FIG. 1), other sensor units and output devices (not shown in FIG. 1). For example, the server storage unit 122 can store data in respect of the operation of the system 100, such as authorization data, access management data of the locking devices 110, facility data, and monitoring data of the secured space.

Authorization data of the locking devices 110 can relate to identification of users who are authorized to access space secured by a particular locking device or the identification of tokens that are authorized to access the secured space. Authorization data of the locking devices 110 can also relate to a status of the secured space, such as whether the secured space is vacant, occupied in good standing, or occupied in poor standing (i.e., virtually overlocked).

Access management data of the locking devices 110 can relate to security requests, security commands, and the operating data. Access management data typically includes temporal information, such as the date and time of events such as the date and time that security requests are received and that security commands are generated. Access management data generally forms a log or ledger of access for the secured space. That is, tenants and/or central managers can review the access management data to determine who has accessed the secured space, via the security requests and/or the security commands that were generated, and the operating data of the locking device 110.

Facility data can relate to the physical environment of the facility, and the location of system components within the facility including but not limited to secured spaces, components of the communication network 120 (e.g., nodes that are described below), or sensor units, and output devices. The location can relate to a building, wing, or floor, or other relevant area identifier of the facility. It should be noted that locations can include both indoor and outdoor locations in and around the facility.

Monitoring data of the secured space can be received from other sensor units and output devices. Monitoring data can relate to an operating state of an access point to which the locking device is fastened to. The operating state of the access point can be an open state or a closed state. Monitoring data of the secured space can also relate to image data, motion data, lighting data, and heat data of the secured space The server storage unit 122 can also store computer programs that are executable by the server processing unit 124. For example, the computer programs can facilitate communication between the server 120 and the locking devices 110. Another example computer program can be an advanced image processing application. The server storage unit 122 can also store computer programs that are downloadable and executable by user computing devices to facilitate communication between the server 120 and the user computing devices.

In some embodiments, the server storage unit 122 can instead be separate from the server 120 and be accessible to the server 120 via the communication network 130.

The server processing unit 124 can control the operation of the server 120. The server processing unit 124 may be any suitable processing units, controllers or digital signal processors that can provide sufficient processing power depending on the configuration, purposes and requirements of the server 120. In some embodiments, the server processing unit 124 can include more than one processing unit with each processing unit being configured to perform different dedicated tasks. The server processing unit 124 together with the lock processing unit 114 at the locking devices 110 contribute to the control of the system 100.

The server communication interface 126 facilitates communication between the server 120 and the other components of the system 100, such as the locking devices 110 and other sensor units and output devices, via the communication network 130. The server 120 can also connect to the Internet.

Some components of the server 120 may be virtualized in a cloud computing infrastructure. A cloud computing infrastructure can improve reliability and maintenance of the server. A cloud computing infrastructure can also allow a system 100 to manage client information and provide access control across a plurality of facilities.

To control access of a facility, the server processing unit 124 can generate security commands for the locking devices 110 based on a security request from a user at a user computing device and authorization data stored in the server storage unit 122. In addition, the server 120 can integrate and control several subsystems, that is, other sensor units and output devices, from one or more facilities. These subsystems can include access gates, doors, lighting, security cameras, and the communication network 130.

To determine whether or not to generate a security command, the server processing unit 124 can process a security request to obtain requesting data. The server processing unit 124 can determine whether the requesting data corresponds to authorization data stored on the server storage unit 122. For example, the requesting data can include account information or a digital authorization token. If the account information or digital authorization token of the requesting data does not correspond to authorization data stored on the server storage unit 122 for that locking device 110, the server processing unit 124 can determine that the security request should not be granted, that is, a security command will not be generated. If the authorization data for that locking device does correspond to authorization data for that locking device 110, the server processing unit 124 can further determine whether the security request should be granted based on the status of the secured space.

The server processing unit 124 can block access to a locking device 110, by not generating a security command and not transmitting a security command to the locking device 110. For example, the server processing unit 124 can determine that access to the secured space should not be granted if the fees for that locking device 110 has not been paid. In this manner, the secured space can be virtually overlocked.

The server processing unit 124 can generate alerts based on analysis of the operating data of the locking devices 110 and/or the monitoring data of the secured space. The alerts can be transmitted to a central manager at a user computing device. A central manager can include personnel located on-site (i.e., local) or off-site (i.e., remote) such as employees, site managers, and corporate administrators.

For example, a user may enter an entrance gate of the facility and that user is the only user in the facility. The server processing unit 124 can identify a locking device 110 and a storage unit associated with the user account of the user. If a locking device 110 that is not associated with the user account communicates operating data indicating that the locking device 110 is being manipulated, then an alert can be triggered. In some embodiments, the alert can be automatically transmitted to the user to let them know that they are at the wrong unit or the wrong floor.

In some embodiments, the alert can also cause image data, including video data, to be automatically provided to a site manager. The site manager may not be on site at the time and can view the alert and the image data on a user computing device to assess the situation. If the site manager observes that the user appears to be innocently attempting to access the wrong unit, the site manager can send a message to the user to assist and/or guide them to the correct unit. For example, the site manager can let the user know that they are on the wrong floor.

Alerts can be triggered based on any event including but limited to timed events, unexpected behavior, or missing events. For example, a user can enter the site and unlock their self-storage unit. If a long duration, such a several hours, passes without a locking event, an alert may be triggered. In another example, when two distinct users enter the main gate and only one locking device 110 is unlocked, an alert may be triggered. In another example, once the user enters the site, alerts can be provided to guide the user to their self-storage unit. More specifically, upon entering the site, communication from the user computing device to nodes of the communication network 130 can be used to determine the location of the user. For example, the alerts can provide directions including but not limited to "continue to the end of the hallway", "turn left", "turn right", "take the elevator", etc.

In another example, an alert may be triggered when the locking device 110 is in the locked state but also the open state. This can occur if the locking device 110 has been physically tampered with, such as cut or broken, which is typically performed by someone who does not have, or cannot obtain authorization to unlock the locking device 110 (e.g., theft or tenant in poor standing circumventing an overlock).

In another example, an alert may be triggered when the locking device 110 is in the closed state but also the unlocked state for some period of time. This can occur if a user has physically closed the locking device 110 and failed to provide a command to lock the locking device 110. That is, after a locking device 110 is physically closed, the system can expect to receive a locking command within some period of time. After such time has elapsed without receipt of a locking command, the alert can be triggered. This can occur when, for example, a user simply forgets to provide the command, or if a failure occurs in the transmission of the lock command between the user computing device, the server 120, and the locking device 110.

The server processing unit 124 can update the authorization data based on the access management data, monitoring data and/or information received from the user. For example, when a tenant moves out, the tenant may submit a vacancy notice. A vacancy notice can include capturing image data of the empty secured space and transmitting the image data to the server 120. The server processing unit 124 can operate an image processing application to assess whether the received image data shows an empty secured space. If the server processing unit 124 determines that the secured space is empty, the authorization data for that locking device 110 can be updated from an occupied in good standing status to a vacant status. In this manner, the secured space can be placed in a vacant status without manual input.

In some embodiments, the server processing unit 124 can also process the image data to verify identifying information, such as a unit number. In some embodiments, the server processing unit 124 can also process metadata related the image data to confirm the location that the image data was captured, or the time that the image data was captured. In some embodiments, the image data can be captured by other system components such as sensor units (described in more detail below).

In some embodiments, alerts can relate to authorization data. The server storage unit 122 can store a list of user accounts to be notified when a particular, or a type of secured space becomes vacant. For example, some users be looking to rent a self-storage unit and others may be looking for a larger self-storage unit. When a secured space becomes available for rent, that is, when the status of the corresponding locking device 110 becomes vacant, an alert can be transmitted to user accounts who wish to be notified. Users may then rent the vacant self-storage unit from the computer program executing on the user computing device. Upon the new tenant completing the rental process such as agreeing to a rental agreement, providing payment, and any other requisites, the server processing unit 124 can update the authorization data for that locking device 110 from the vacant status to the occupied in good standing status.

Corporate administrators, including district managers, can have access to multiple servers 120 that manage individual facilities or a single server 120 that is configured to manage multiple facilities. An account associated with a corporate administrator can have different analytics and views from what the site managers can view. However corporate administrators and site managers can have a similar level of access and control. In particular, corporate administrators and site managers can each have the ability to block access to (i.e., virtually overlock) an individual locking device.

The locking devices 110, the user computing devices, and the server 120 may communicate via the communication network 130. In some embodiments, more than one communication network 130 can be provided. For example, the locking devices 110 and the server 120 can communicate via first communication network 130 while the user computing devices and the server 120 can communicate via a second communication network 130. In some embodiments, some locking devices 110 and/or user computing devices can communicate with the server 120 via a first communication network 130 while other locking devices 110 and/or user computing devices can communicate with the server 120 using a second communication network 130.

The communication network 130 may be any network capable of carrying data, including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX, Zigbee, Z-Wave, Bluetooth®, Bluetooth® Low Energy, Long Range "LoRa"), SS7 signaling network, fixed line, local area network, wide area network (e.g., Long Range Wide Area Network "LoRaWAN"), and others, including any combination of these, capable of interfacing with, and enabling communication between the server 120, the locking devices 110, and user computing devices (not shown in FIG. 1).

The communication network 130 can include a network of nodes. The network of nodes can include one or more nodes for transmitting and receiving data from the components of the system 100 located in a facility, such as locking devices 110, user computing devices, and sensor devices. The network of nodes can be connected together. The network of nodes can be connected to the server 120. In some embodiments, the network of nodes can be connected via a wired connection and/or over a wireless connection. In some embodiments, nodes may include a video camera to collect visual information of the locking devices and/or the environment around the locking devices. The cameras may be a thermal camera, a digital camera, or the like. In some embodiments, the cameras may be generally maintained in a sleep state and programmed to awake upon receiving a signal indicating that the locking device or a door associated with a locking device has been opened. In some embodiments, the camera may be used to confirm a status of the door (e.g. open/closed). In some embodiments, the camera may be used to detect a thermal change in the door (e.g. detect whether the door is open/closed based on a thermal change).

For example, each locking device 110 and user computing device may be equipped with a wireless communication interface to enable wireless communications according to a wireless protocol (e.g. LoRa, Bluetooth®, Bluetooth® Low Energy, Zigbee, or Z-Wave). Other components of the system 100 (e.g., sensor units and output devices) may also communicate using the communication network 130.

In some embodiments, the communication network 130 can be physically connected to the server 120. In some embodiments, the server 120 may be equipped with a wireless communication interface to enable wireless communications according to a Wi-Fi protocol (e.g. IEEE 802.11 protocol or similar).

The location of nodes can be pre-determined and stored on the server storage unit 122 as facility data. When a node communicates data received from a locking device 110 and/or user computing device to the server 120, the node can also provide self-identifying data that the server 120 uses to determine the location of the locking device 110 and/or user computing device from which the data originated based on the location of the node. In some embodiments, the location of the node can be taken as the location of the locking device 110 and/or user computing device. In other embodiments, the location of the locking device 110 and/or user computing device can be determined based on the location of a plurality of nodes. Any appropriate algorithm for determining the location of the locking device 110 and/or user coming device based on the location of a plurality of nodes can be used, including but not limited to triangulation.

In some embodiments, the other components of the system 100 can include sensor units, output devices, gate controls, door sensors, cameras, motion detectors, and lights. Sensor units can collect data from the environment of the secured space. For example, the one or more sensors can include a LiDAR device (or other optical/laser, sonar, radar range-finding such as time-of-flight sensors). The one or more sensors can include optical sensors, such as video cameras and systems (e.g., stereo vision). The one or more sensor units can include motion sensors, light sensors, or heat sensors.

The user computing devices may be any networked device operable to connect to the communication network 130. A networked device is a device capable of communicating with other devices through a network such as the communication network 130. A networked device may couple to the communication network 130 through a wired or wireless connection. LoRa, Bluetooth® or Bluetooth® Low Energy are examples of a wireless protocol that the user computing device use to connect to the communication network 130.

User computing devices may include at least a processing and memory, and may be an electronic tablet device, a personal computer, workstation, server, portable computer, mobile device, personal digital assistant, laptop, smart phone, wearable device, an interactive television, a video display terminal, gaming console, and portable electronic devices or any combination of these.

The user computing device can operate computer programs to facilitate communication with the server 120 and/or communication network 130. The computer program can be downloaded from the server 120 or from a third-party server, such as an application store. Once the computer program is downloaded onto the user computing device, it can be executed by the user computing device. In some embodiments, the system 100 can include the computer programs that facilitate communication with the server.

In addition, the computer programs may be specific to the type of user. That is, the computer program for a client (i.e., a tenant) can be different from a computer program for a central manager (i.e., corporate administrators, district and/or site managers). The computer program for central managers can have additional functionalities compared to that of clients. For example, the central managers can access a mapping tool for illustrating status of a plurality of storage units.

In other embodiments, the user computing device can operate an Internet browser to access a web portal that provides a similar function to the computer program. That is, a web portal can be used to facilitate communication with the server 120.

Functions of the computer program operating on the user computing device to facilitate communication with the server 120 and/or communication network 130 may be dependent on its connection to the communication network 130 or a particular node of the communication network 130. This can allow functions of the computer program to be disabled or enabled based on the location of the user computing device. For example, the submission of a security request to the server 120 to unlock or lock a locking device 110, or the submission of a vacancy notice using the user computing device may be enabled or disabled when the user computing device is or is not in communication with the communication network 130, including a particular node or any nodes of the communication network 130. Communication with the communication network 130 can rely on the signal strength of the user computing device to the communication network 130. Based on the signal strength of the user computing device to the communication network 130, the location of the user computing device on site or in proximity to a particular locking device 110 can be determined. In some embodiments, the location of the user computing device can be determined by GPS operating on the user computing device.

It can be convenient to access self-storage units using a user computing device such as a smartphone since smartphones are widely used. If at the last minute a user requires access to their self-storage unit, they are much more likely to have their smartphone with them than a physical key for their self-storage unit.

In some embodiments, the user computing device can be used remotely to provide a digital authorization token to a trusted third-party for access (i.e., guest access) to the locked space. The digital authorization token can expire or be revoked. For example, the digital authorization token may expire after a pre-determined period of time from issuance. In another example, the digital authorization token may expire after a pre-determined number of uses. In some embodiments, the user can revoke the digital authorization token.

The user computing device can also allow account management (i.e., personal or corporate accounts) and payments, and/or provide the account status, site status, and alerts.

Figure 2:
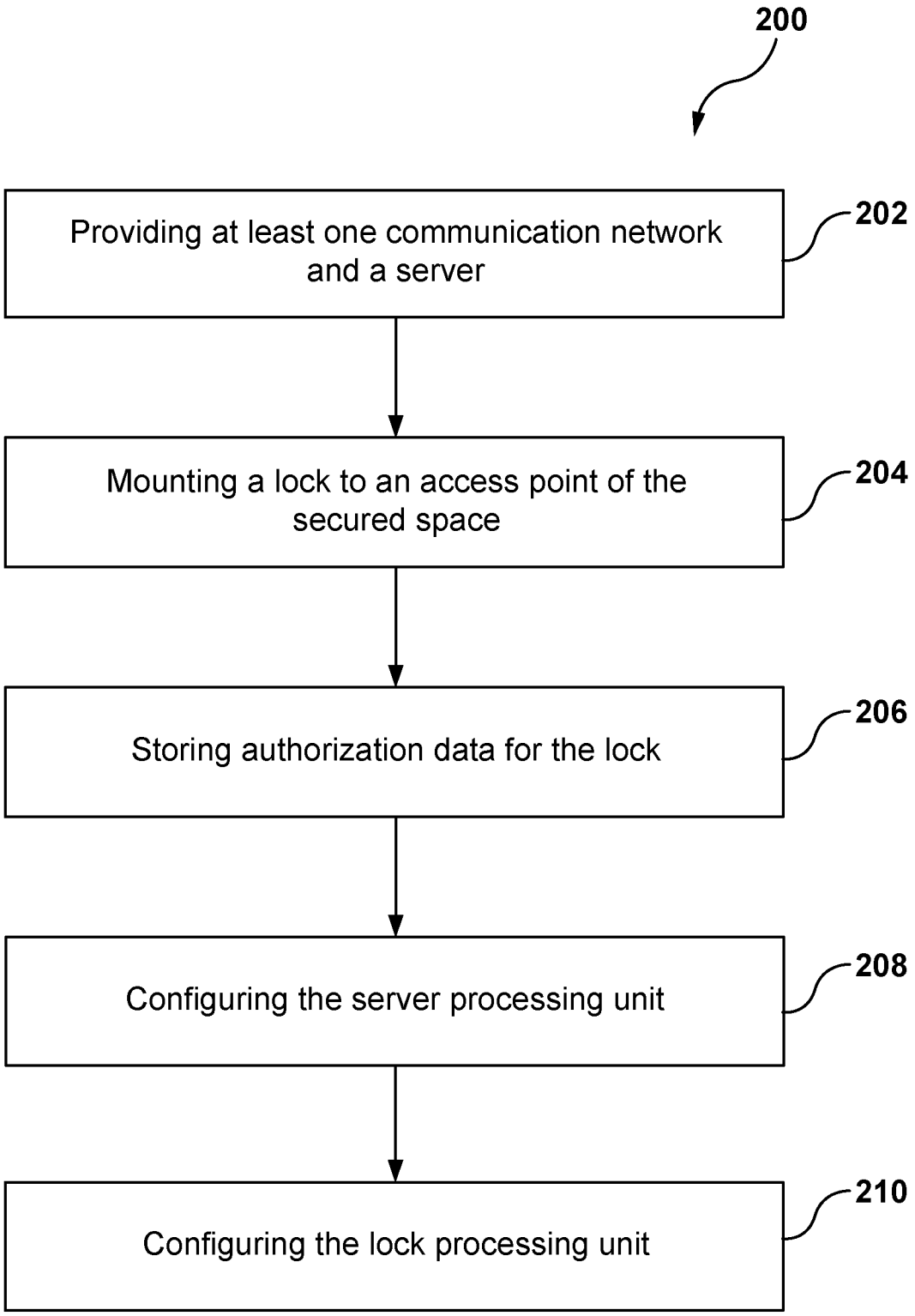
FIG. 2 is an example method for providing controlling access to a secured space, according to at least one embodiment.

Referring now to FIG. 2, steps for an example method of controlling access to a secured space is shown in a flowchart diagram 200. At step 202, at least one communication network 130 and a server 120 can be provided.

At step 204, a locking device 110 can be fastened to an access point of the secured space. The locking device 110 can be positioned so that in the locked state, the locking device 110 can maintain the access point closed and in the unlocked state, the locking device 110 can allow the access point to be opened.

At step 206, authorization data for the locking device 110 can be stored on the server storage unit 122. The authorization data can be received from a user computing device. The user computing device can be associated with a tenant or a central manager, including personnel located on-site or off-site such as employees, site managers, and corporate administrators.

At step 208, the server processing unit 124 can be configured. The server processing unit 124 can be configured to receive a security request for the locking device 110 from a user computing device and determine whether the security request includes requesting data that corresponds to the authorization data stored for that locking device 110. In response to determining that the requesting data corresponds to the authorization data stored for the locking device 110, the server processing unit 124 can be configured to generate a security command based on the security request and to communicate the security command to the locking device 110.

At step 210, the lock processing unit 114 can be configured to generate a control signal for the actuator based at least in part on the security command.

Figure 3:
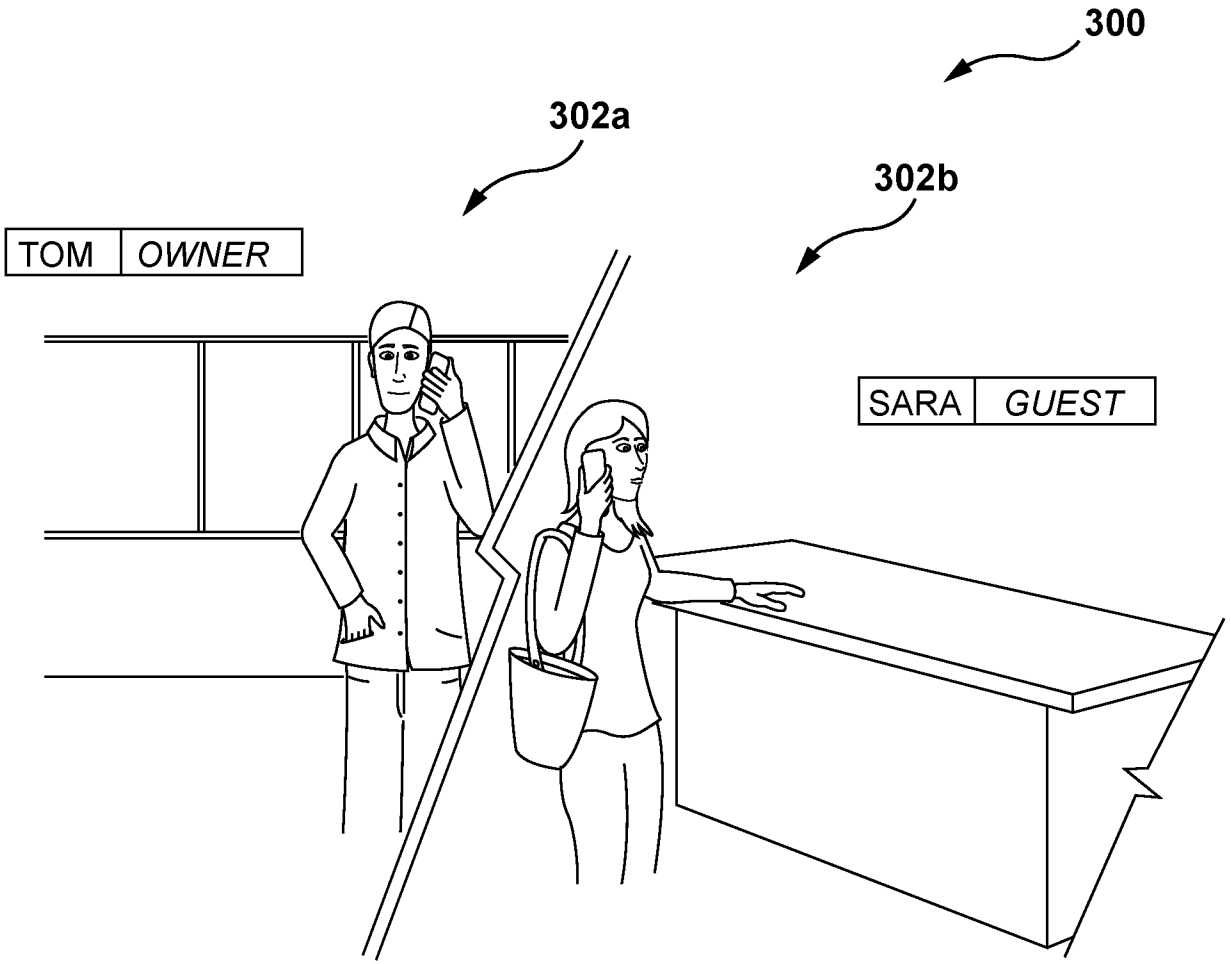
FIG. 3 is an illustration of an example scenario for requesting access to a secured space, according to at least one embodiment.
Figure 4A:
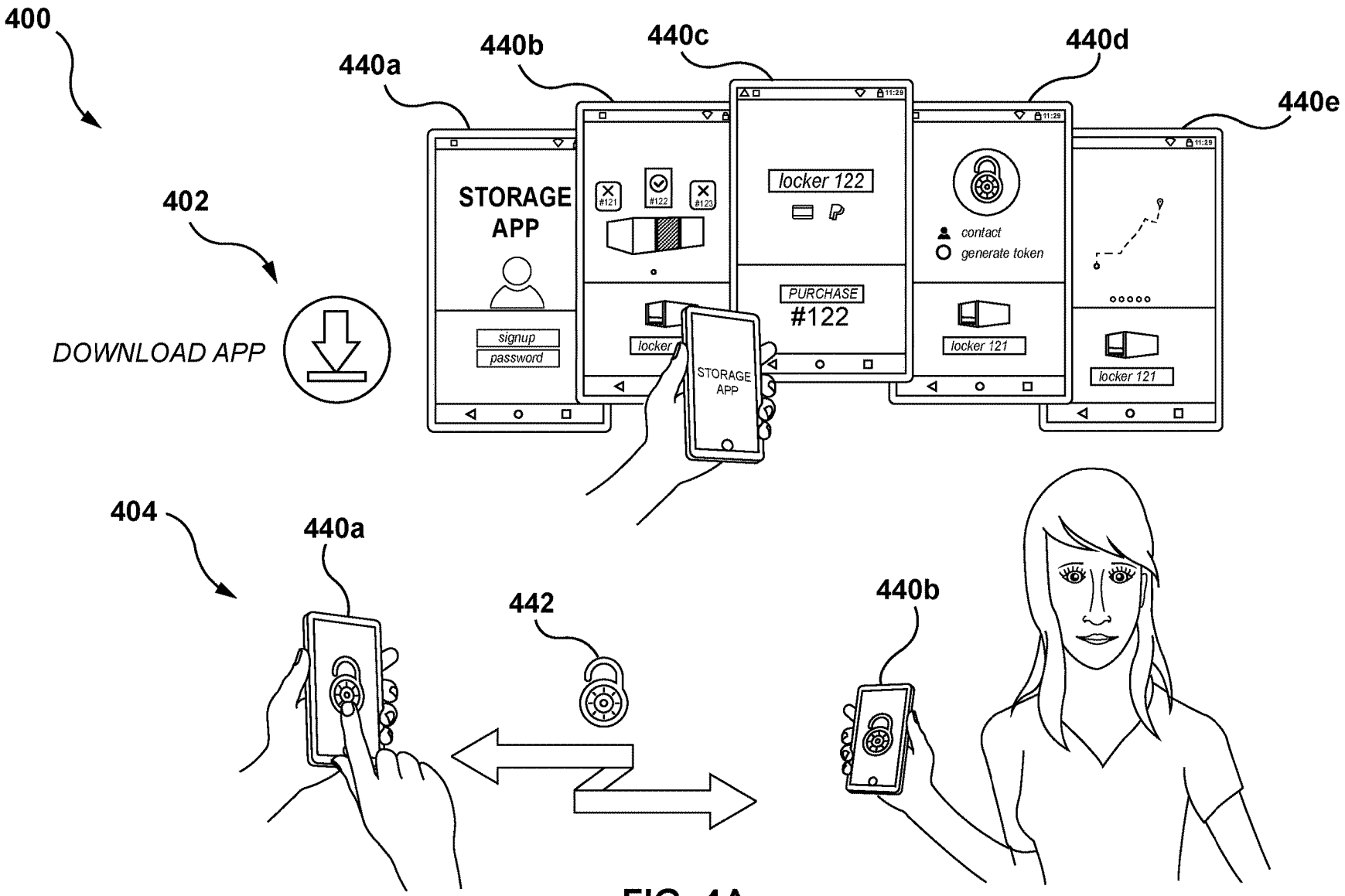
FIGS. 4A and 4B are illustrations of an example method for accessing a secured space, according to at least one embodiment.
Figure 4B:
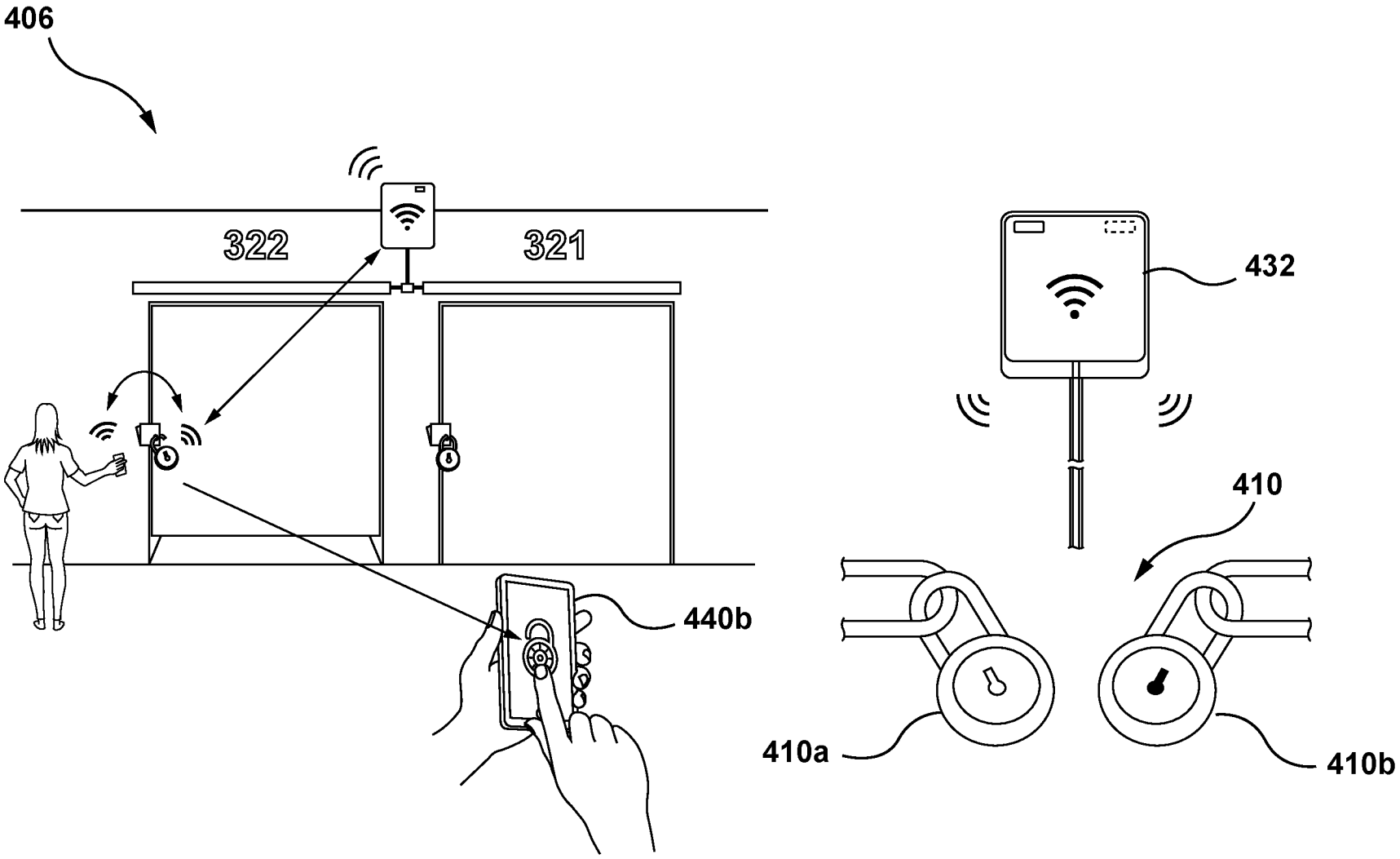

Reference will now be made to FIGS. 3, 4A, and 4B simultaneously. FIG. 3 illustrates an example scenario 300 for requiring access to a secured space and FIGS. 4A and 4B illustrate an example method 400 of requesting access to a secured space, according to at least one embodiment. In this example, the secured space is a self-storage unit.

In scenario 300, a tenant has stored items in their self-storage unit at a self-storage facility 302*b*. The tenant is the only user with access to the self-storage unit. A trusted third-party requires an item stored in the tenant's self-storage unit. However, the tenant is located in a first location 302*a* and cannot conveniently go to the self-storage unit to retrieve the item. Furthermore, the tenant's key is located at the tenant's home, a second location. The trusted third-party does not have access to the tenant's home to retrieve the key. The tenant trusts the third-party with access to the self-storage unit but the third-party was not setup on the self-storage unit account because the tenant did not foresee that the third-party would require access.

In method 400, at step 402, the trusted third-party can download and execute the computer program onto their user computing device 440 to facilitate communication with the server 120 from their user computing device 440. The trusted-third party may use the computer program setup an account. At step 404, the tenant can use the computer program on their user computing device 440 to share access with the trusted third-party. More specifically, the tenant can transfer a digital authorization token 442 to the trusted third-party's user computing device 440 to allow the trusted third-party's user computing device 440 to submit a security request to the locking device 410 (shown in FIG. 4B) for the tenant's self-storage unit.

At step 406, the trusted third-party can go to the site of the self-storage unit 302*b*. Using their user computing device with the computer program operating therein, the trusted third-party can obtain access through the main access gate, locate the tenant's self-storage unit 444*a*, and submit a security request to unlock the locking device 410. The security request from the user computing device can be communicated wirelessly to the server 120, via the communication network 130. The communication network 130 can include one or more nodes 432 for transmitting and receiving data from the components of the system 100 located in a facility including user computing devices 432. LoRa, Bluetooth® or Bluetooth® Low Energy can be used to communicate the security request from the user computing device 440 to the server 120.

The security request can be processed by the server 120. The security request can include requesting data, such as a password passcode, or fingerprint data that are related user account information, or a digital authorization token. If the requesting data corresponds to authorization data, the security request may be granted. In this case, if the requesting data includes the third-party's account information, the security request would not be granted because the tenant's account information is associated with the locking device 410. However, the requesting data can be the digital authorization token transmitted from the tenant's user computing device. Upon determining that the digital authorization token corresponds to authorization data for the locking device 410*a*, the security request can be granted.

When the security request is granted, a security command is generated for a security request. The security command is transmitted over the communication network 130 to the locking device 410. For example, for an unlock command, the locking device 410 unlocks and the trusted third-party is able to pull down the body of the locking device 410, releasing the shackle so the locking device 410 can be removed and the door to the self-storage unit can be opened. If authorization data for the locking device 410*b* indicated that the tenant's account was in poor standing (i.e., virtually overlocked), then the security request may not be granted and the security command is not generated or communicated. An account may be in poor standing for non-payment of rental fees and other issues. In some embodiments, the server processing unit 124 can store at least a portion of the security request and/or the security command on the server storage unit 122.

Figure 5:
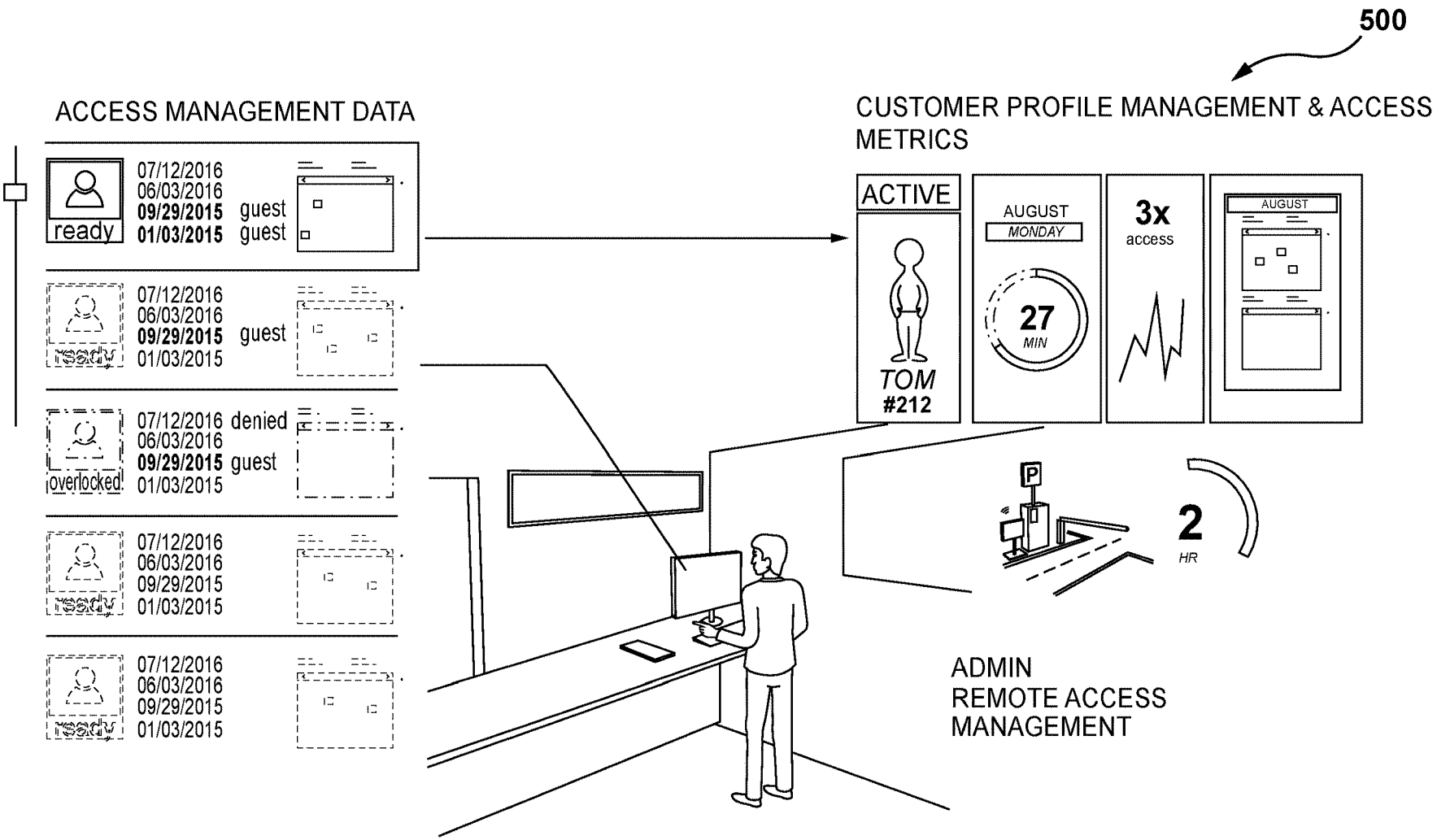
FIG. 5 is an illustration of data that can be made available by the system, according to at least one embodiment.

Referring now to FIG. 5, shown therein is an illustration 500 of data that can be made available by the system 100 to central managers, according to at least one embodiment.

The central managers can review statuses of user accounts (i.e., customer profile management), access management data and metrics, or system alerts generated based on monitoring data. The central managers can access this data on-site or remotely from a user computing device via a web portal or a computer program.

Figure 6:
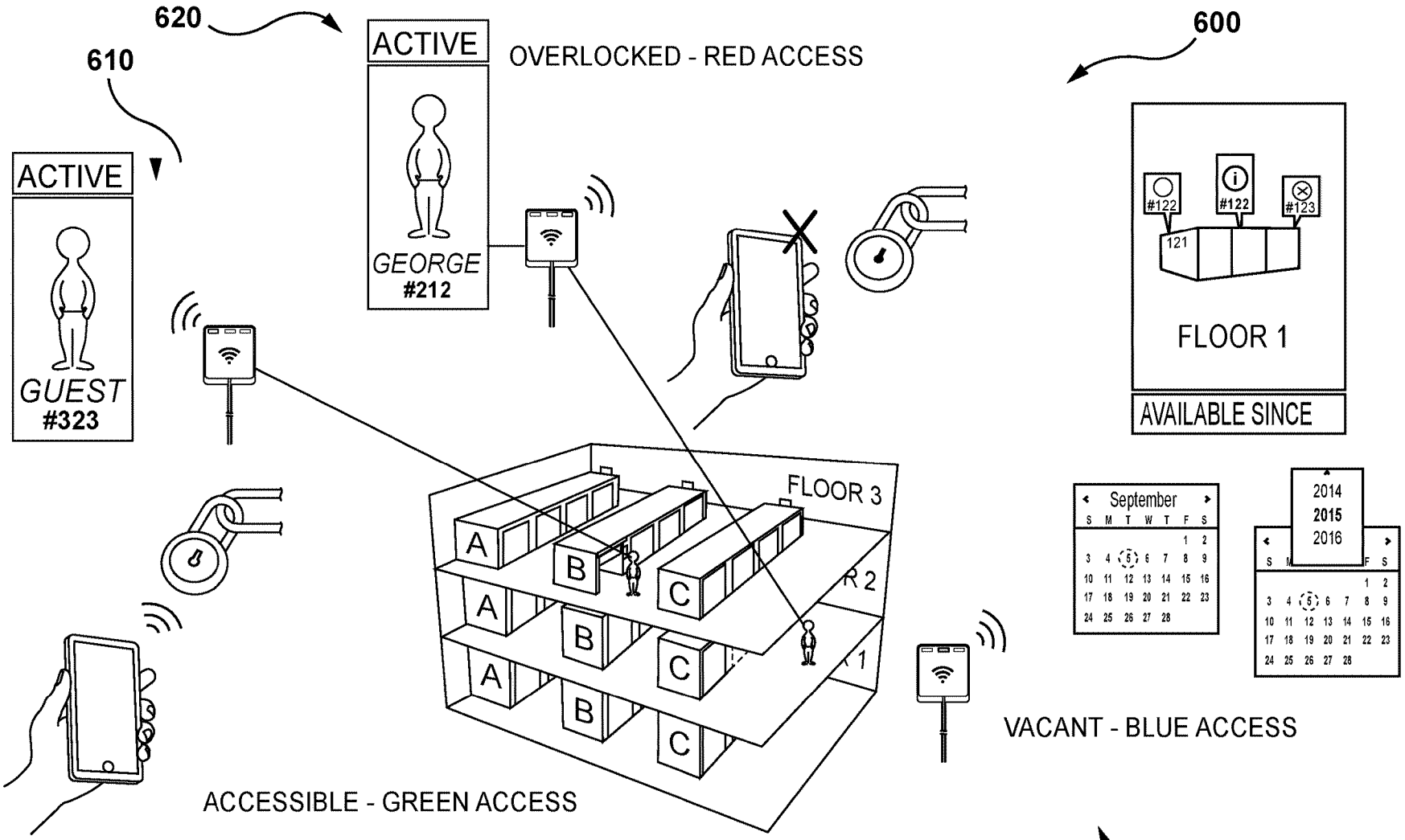
FIG. 6 is an illustration of different statuses that secured spaces can have, according to at least one embodiment.

Referring to FIG. 6, shown therein is an illustration 600 of different statuses that secured spaces can have, according to at least one embodiment. In this example, the secured space is a self-storage unit. The status of the self-storage units at a site can be illustrated in a mapping tool of the computer program for central managers. Statuses illustrated can include, but is not limited to: (1) occupied and accessible (i.e., good standing) 610; (2) occupied and virtually overlocked (i.e., poor standing) 620; and (3) vacant 630. Each of the statuses in the mapping tool can also be color coded. For example, occupied and accessible 610 can be green; occupied and virtually overlocked 620 can be red; and vacant 630 can be blue.

Figure 7:
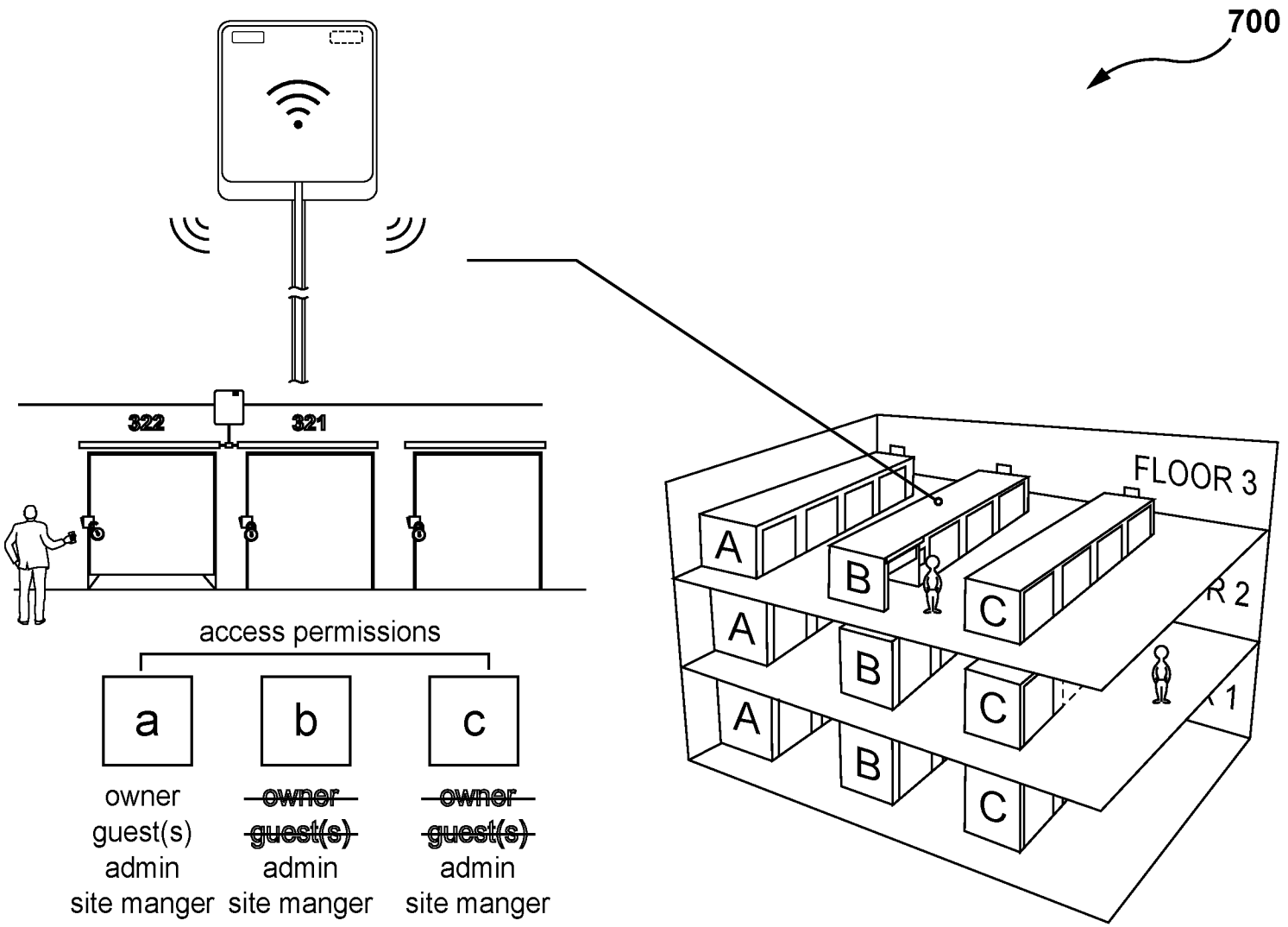
FIG. 7 is an illustration of different permissions to the secured spaces, according to at least one embodiment.

Referring to FIG. 7, shown therein is an illustration of different permissions to secured spaces, according to at least one embodiment. In this example, the secured space is a self-storage unit. When a self-storage unit is occupied and in good standing 610, the self-storage unit is accessible by the tenant and any trusted third-parties that the tenant provides access to. When a self-storage unit is occupied and in poor standing 620, the self-storage unit is not accessible by the tenant or any trusted third-parties, including the tenant, until the self-storage unit is returned to good standing. In the meantime, the self-storage unit is accessible by central managers including an administrator and site manager. When a self-storage unit is vacant 630, it is available for rental and accessible by central managers including an administrator and site manager.

Figure 8:
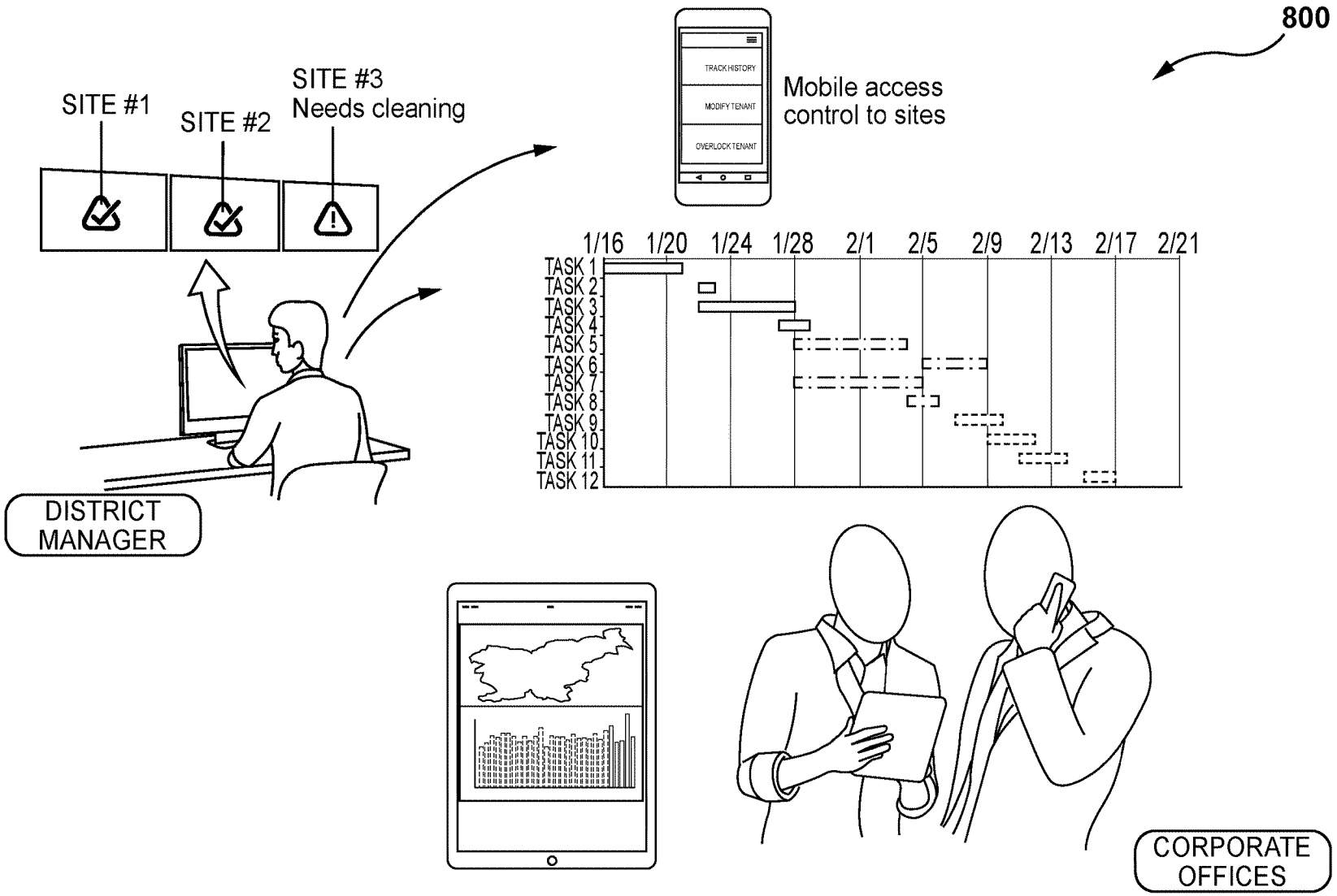
FIG. 8 is an illustration of a district management having control of multiple sites, according to at least one embodiment.

Referring to FIG. 8, shown therein is an illustration 800 of a user computing device of central managers having control of multiple sites, according to at least one embodiment. A computer program operating on the user computing device of a central manager can access data and analytics from all sites, including, but not limited to access frequency information, site vacancy statistics, sales throughput, alert and error notices, and geoanalytics.

Figure 9B:
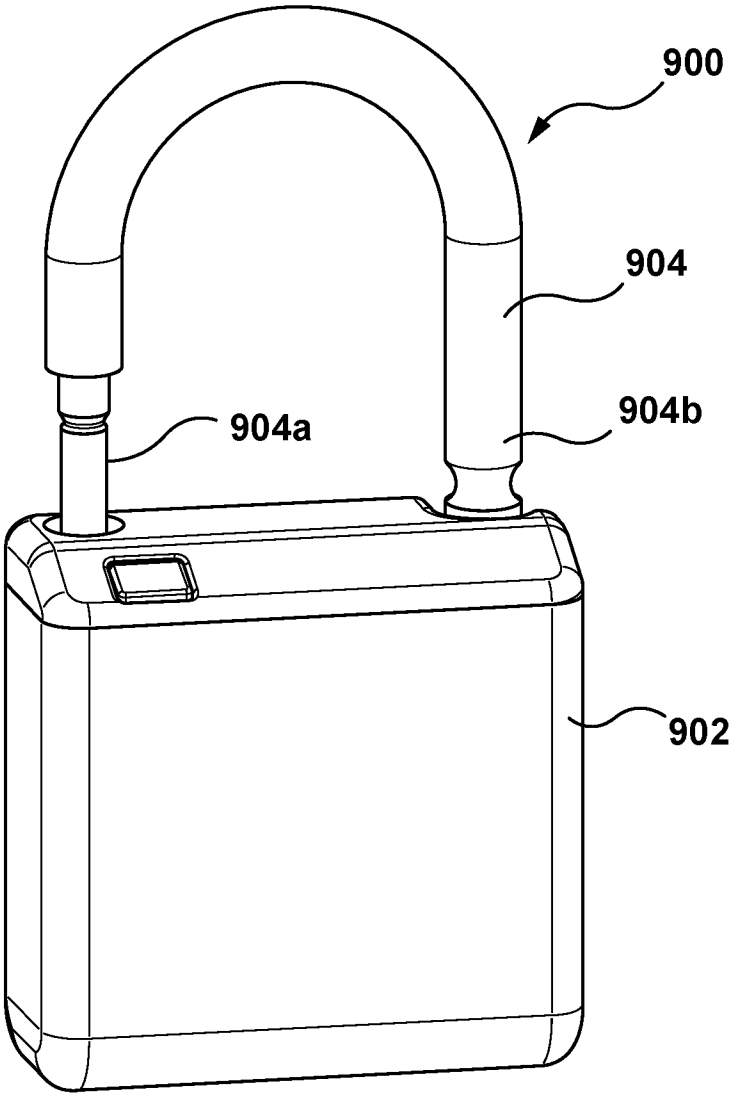
FIGS. 9A and 9B are perspective views of a locking device in a closed state and in an open state, respectively, according to at least one embodiment.
Figure 9A:
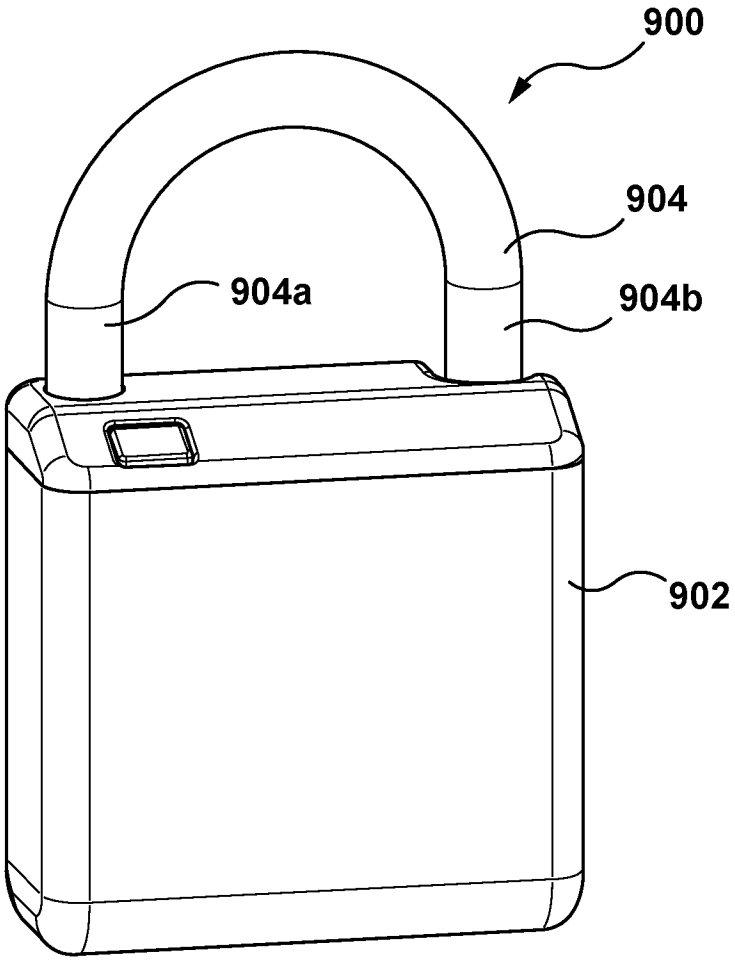

Referring to FIGS. 9A and 9B, illustrated therein are perspective views of a locking device 900 in a closed state and in an open state, respectively, according to at least one embodiment.

FIG. 9A shows the locking device 900 as a pad lock that includes a body 902 and shackle 904 extending outwardly from the body 902.

Shackle 904 has two arms 904*a* and 904*b* and is arranged to be movable between a closed position (see FIG. 9A) wherein bottom portions of both of the arms 904*a* and 904*b* are secured within the body 902 and an open position (see FIG. 9B) wherein the bottom portion of one of the arms is secured within the body 902 and the relative to body 902. When the locking device 900 is in the closed position (see FIG. 9A), the locking device 900 can be in either a locked state, a partially locked state, or an unlocked state.

In at least one embodiment, the shackle 904 can be a part of an electrical circuit and an electrical current can be applied to the shackle 904. When the shackle 904 is closed, the electrical circuit forms a closed loop, providing a signal indicating that the locking device 900 is in the closed state. However, when the electrical circuit does not form a closed loop, that is, when the shackle 904 is open or cut, the signal indicating the shackle 904 is in the closed position is not provided, indicating that locking device 900 is in the open state.

Figure 10B:
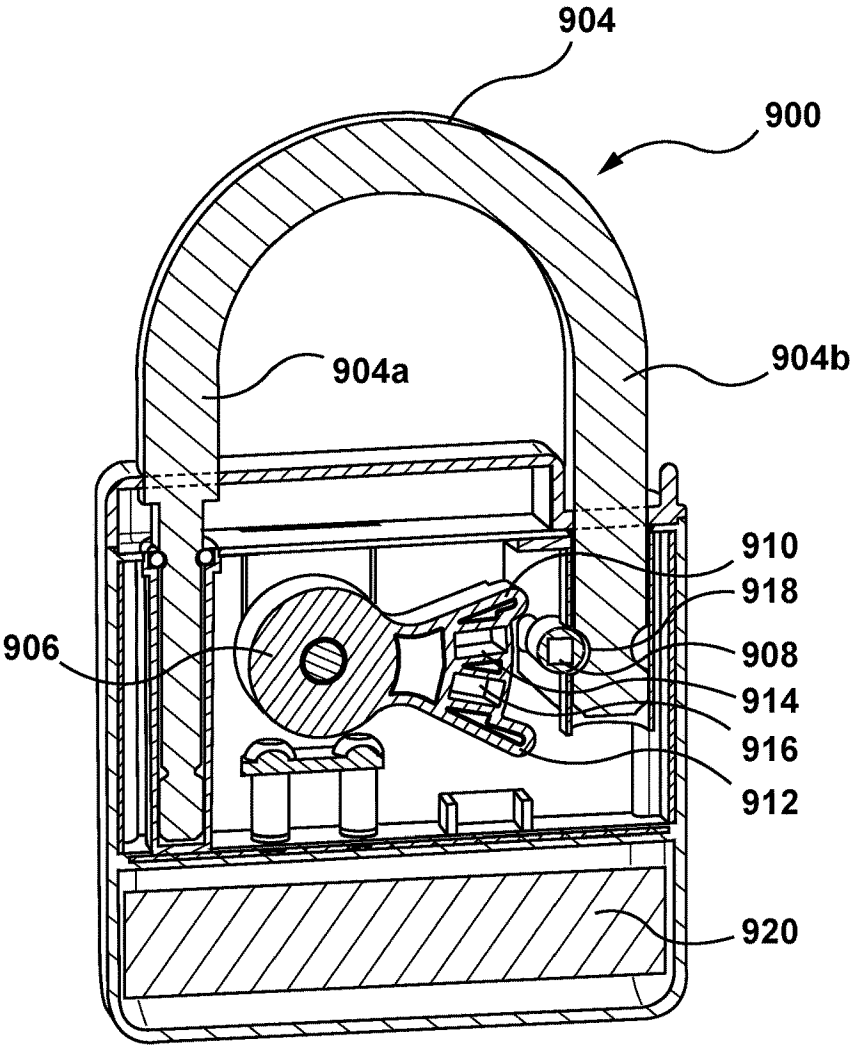
FIGS. 10A and 10B are cross-sectional views from top to bottom of the locking device of FIGS. 9A and 9B showing the main internal components of the locking device in the closed and locked state and in a closed and partially locked state, respectively, according to at least one embodiment.
Figure 10A:
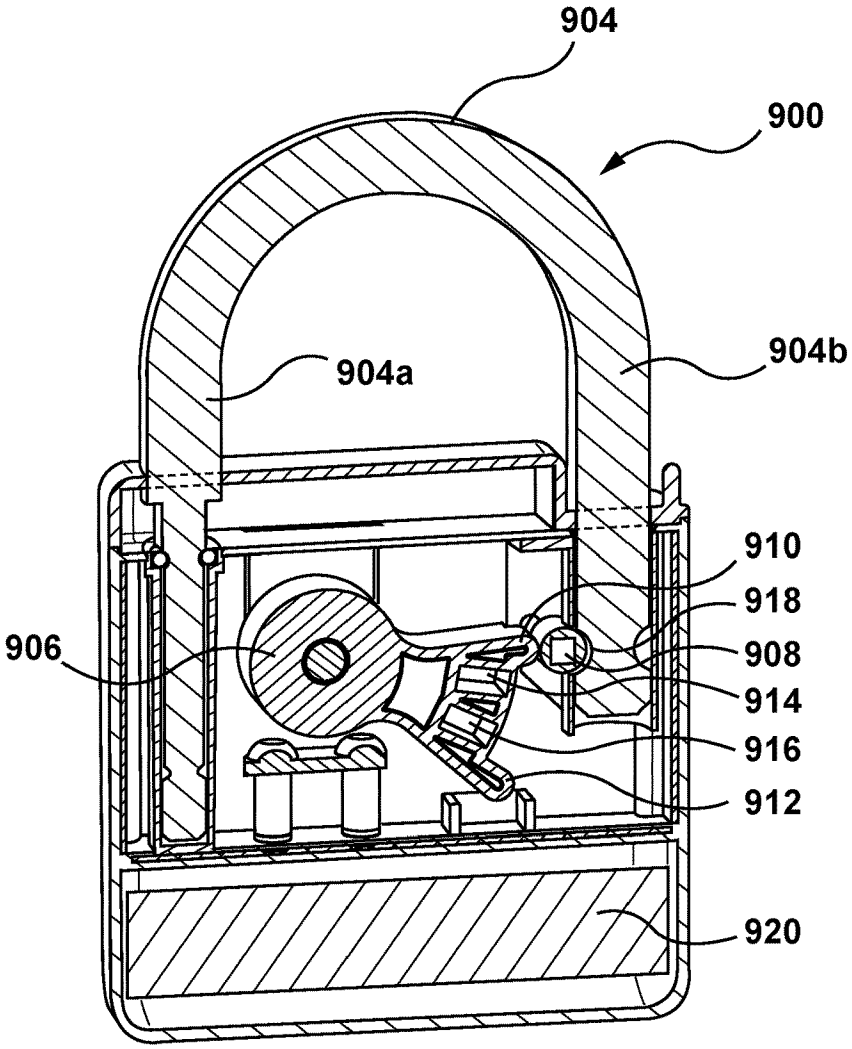

Referring now to FIGS. 10A and 10B, illustrated therein are cross-sectional views from top to bottom of the locking device 900 of FIGS. 9A and 9B showing the main internal components of the locking device 900 in the closed and locked state (see FIG. 10A) and in a closed and partially locked state (see FIG. 10B), according to at least one embodiment.

The body 902 includes a rotatable locking cam 906 and a locking pin 908. Rotation of the rotatable locking cam 906 controls engagement of the locking pin 908 with a groove 918 of one of the arms of the shackle 904 when the locking device 900 is in the closed state. When the locking pin 908 engages the groove 918 of one of the arms of the shackle 904 (e.g. arm 904*b*), the one of the arms is secured within the body 902 and the shackle 904 is retained in its locked position. When the locking pin 908 disengages the groove 918 of the one of the arms of the shackle 904 (e.g. arm 904*b*), the one of the arms is secured within the body 902 and the shackle 904 is free to move to its unlocked position. Rotation of rotatable locking cam 906 is controlled by a drive system (described below).

Rotatable locking cam 906 includes a locked paddle 910 and an unlocked paddle 912. In the embodiment shown in the FIGS. 9A to 13, each of the locked paddle 910 and the unlocked paddle 912 extend towards the one of the arms (e.g. arm 904*b*) of the shackle 904. Locked paddle 910 and unlocked paddle 912 are each generally made of a non-magnetic material. In the embodiment shown in the FIGS. 9A to 13, the locked paddle 910 is positioned vertically above the unlocked paddle 912 in a direction towards a top end of the locking device 900.

Rotatable locking cam 906 also includes a locking magnet 914 and an unlocking magnet 916. Each of the locking magnet 914 and the unlocking magnet 916 are generally made of a magnetic material, however, have opposing north-south poles to repel and attract the locking pin, respectively.

Figure 11A:
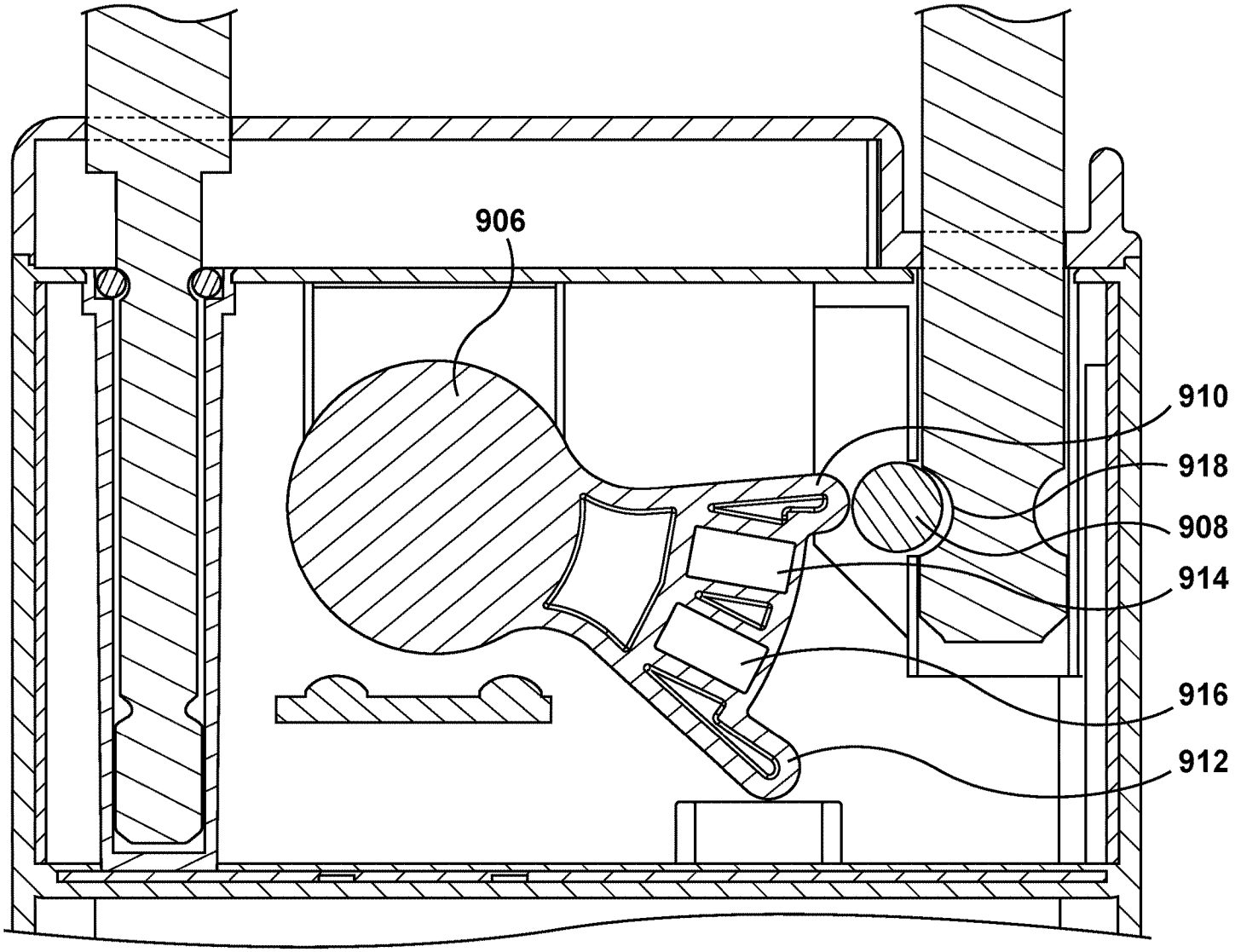
FIGS. 11A and 11B are partial cross-section views from top to bottom of the locking device of FIGS. 9A and 9B showing the main internal components of the locking device in the locked state and in the unlocked state, respectively, according to at least one embodiment.
Figure 11B:
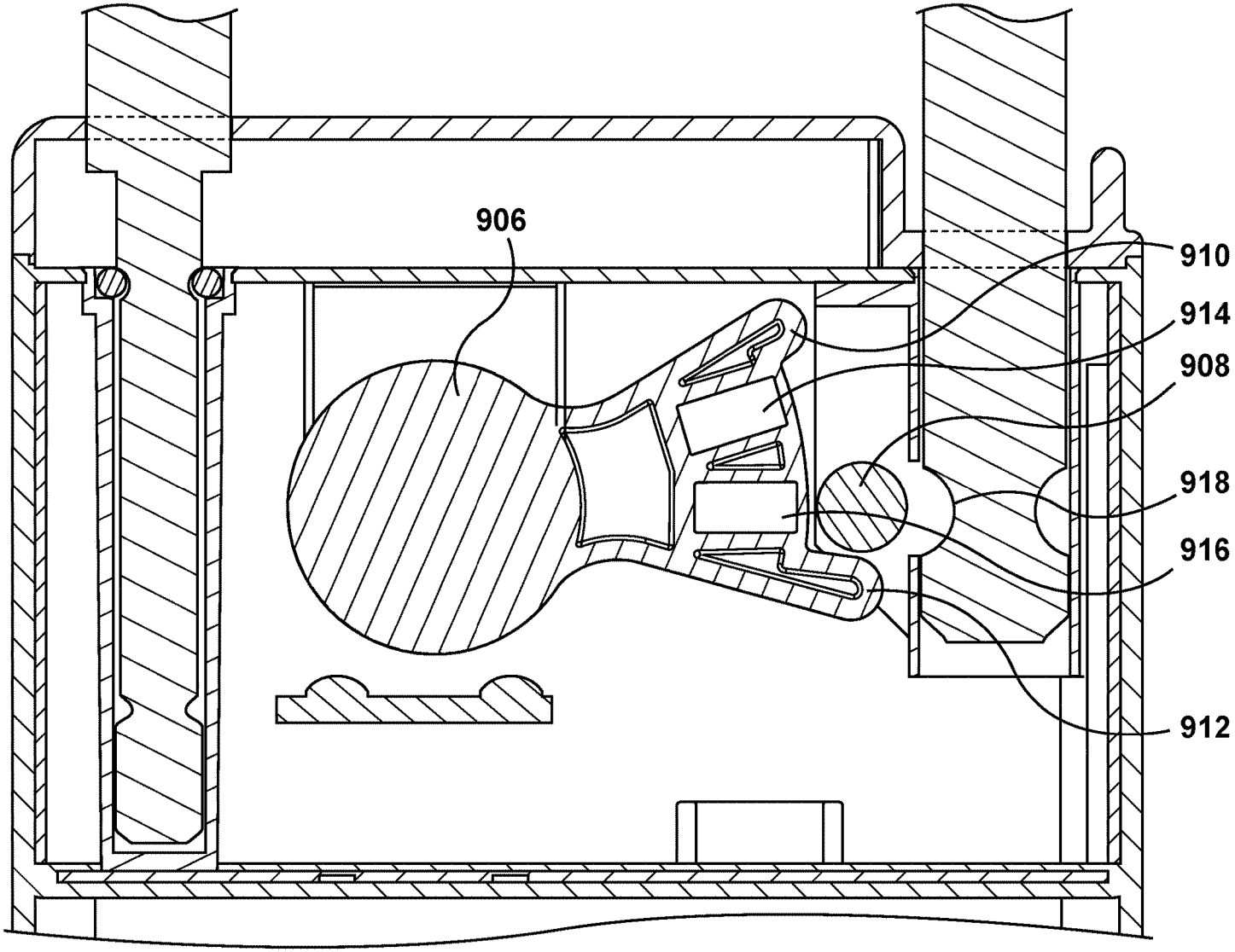

As shown in FIGS. 10A and 11A, when the locked paddle 910 of the rotatable locking cam 106 directly engages the locking pin 908, the locking pin 908 is engaged with a groove 918 of one of the arms of the shackle 904 and the one of the arms of the shackle 904 is retained within the body 902. At this position, the locking device 900 is in a locked state. As shown in FIG. 10B, when the rotatable locking cam 906 rotates, for example in a counter-clockwise direction, the locked paddle 910 disengages from the locking pin 908 and the locking pin 908 remains engaged with the groove 918 of the one of the arms (e.g. arm 904*b*) of the shackle 904 due to a repulsion force between the locking magnet 914 of the rotatable cam 906 and the locking pin 908. In this position, the locking device 900 is in a partially locked state. As the rotatable cam 906 continues to rotate, for example in a counter-clockwise direction, the locking pin 908 disengages from the groove 918 of the one of the arms (e.g. arm 904*b*) of the shackle 904 due to an attraction force between the unlocking magnet 916 of the rotatable cam 906 and the locking pin 908. This is shown in FIG. 11B. In this position, the locking device 900 is in the unlocked state and the locking pin 908 is disengaged from the groove 918 and supported by the unlocked paddle 912. When the locking device 900 is in the unlocked state, the one of the arms of the shackle 904 can be removed from the body 902.

Body 902 also includes a power supply 920 (e.g. battery) for supplying electrical power to the drive system (described below).

Figure 12B:
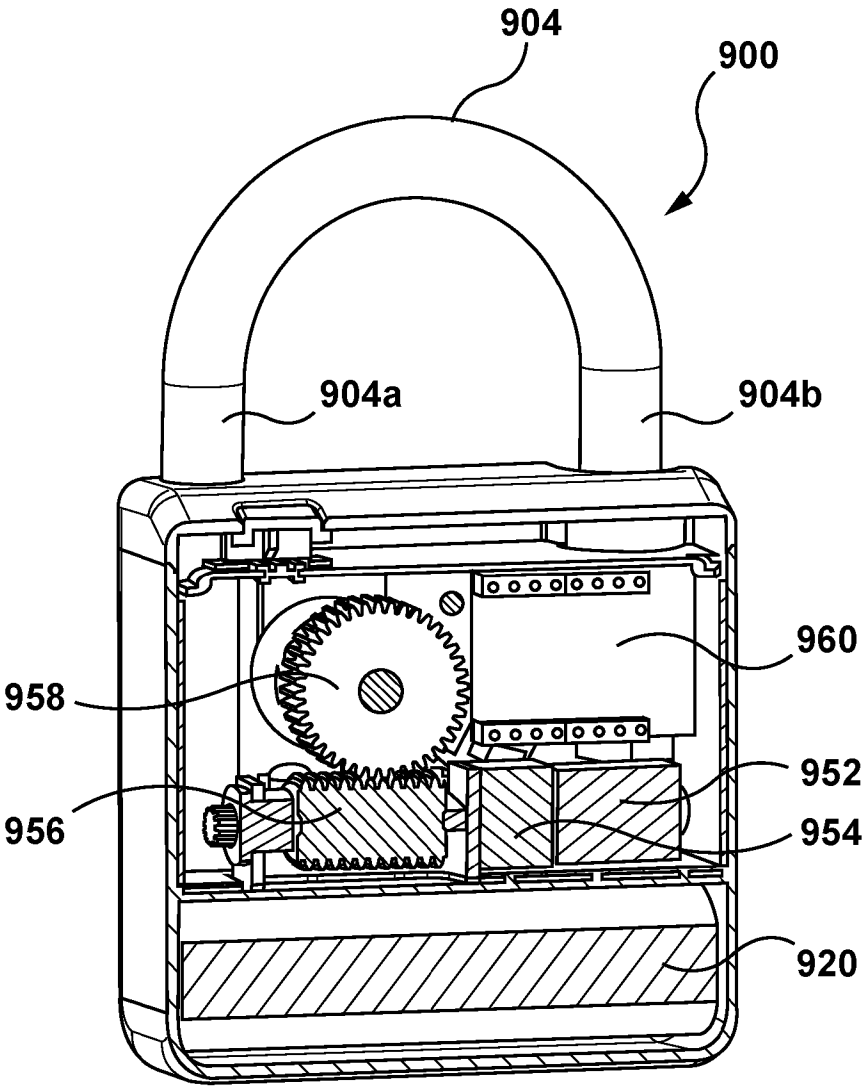
FIGS. 12A and 12B are cross-sectional views from top to bottom of the locking device of FIGS. 9A and 9B in a plane closer to a front panel of the locking device relative to the plane of the cross-sectional views of FIGS. 10A and 10B Hall detect sensor components of the locking device and actuation components of the locking device, respectively, according to at least one embodiment.
Figure 12A:
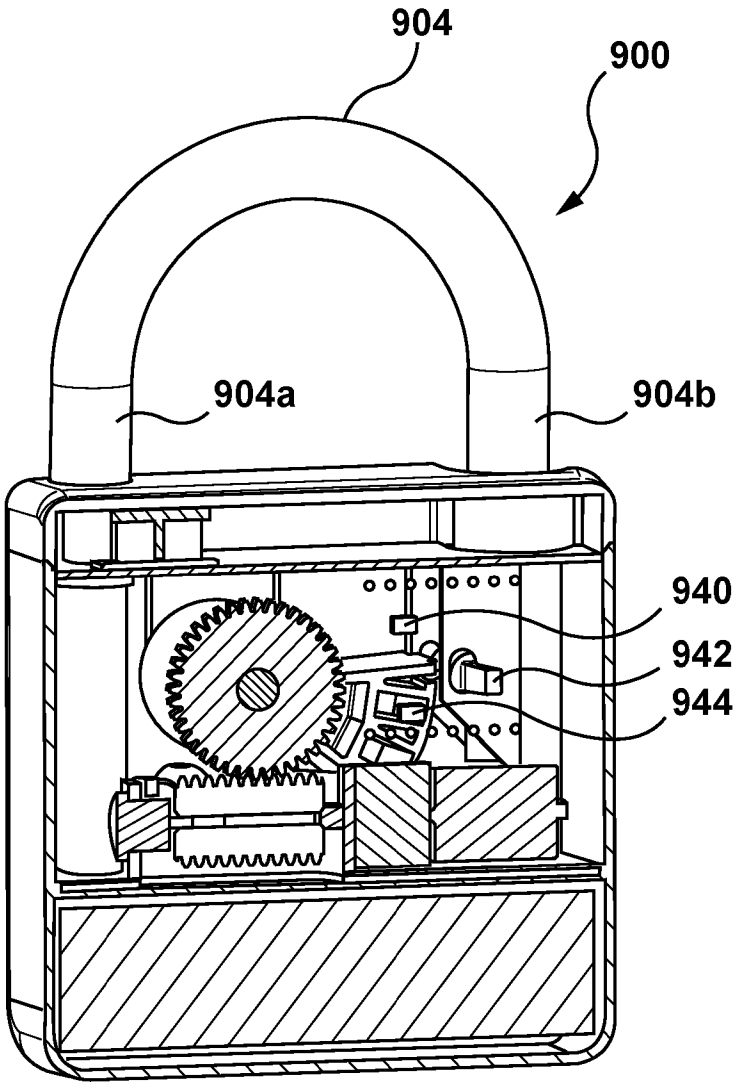

Referring now to FIGS. 12A and 12B, illustrated therein are cross-sectional views from top to bottom of the locking device 900 of FIGS. 9A and 9B in a plane closer to a front panel of the locking device 900 relative to the plane of the cross-sectional views of FIGS. 10A and 10B. In FIGS. 12A and 12B, Hall detect sensor components of the locking device and actuation components of the locking device are shown.

A Hall detect sensor is a transducer that varies its output voltage in response to a magnetic field. In FIGS. 12A and 12B, hall detect sensor 940 detects if locking device 900 is in an unlocked state by detecting if the rotatable locking cam 906 has rotated to a position where the locking pin 908 is disengaged with the groove 918.

Hall detect sensor 942 detects if locking device 900 is in a locked state by detecting if the locking pin 908 is in a position where it is engaged with the groove 918.

Hall detect sensor 944 detects if locking device 900 is in a locked state by detecting if the rotatable locking cam 906 has rotated to a position where the locking pin 908 is engaged with the groove 918.

It should be noted that in the embodiment shown in FIGS. 12A and 12B, all of the hall detect sensors (e.g. hall sensors 940, 942 and 944) are mounted on the PCB 960 (described below).

In other embodiments, limit switches could be used to detect a position of the locking cam 906.

Figure 13:
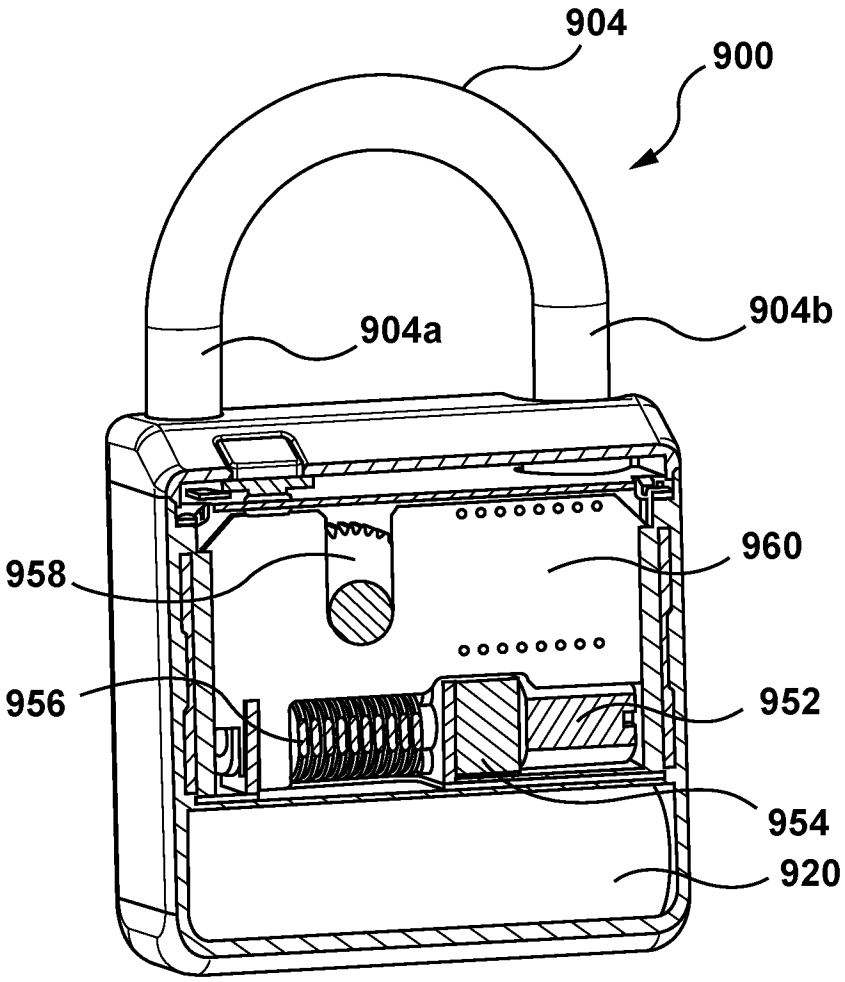
FIG. 13 is a perspective view of the locking device of FIGS. 9A and 9B in a locked state with a front panel of the locking device removed to show the controller and printed circuit board (PCB)

FIG. 13 is a perspective view of the locking device of FIGS. 9A and 9B in a locked state with a front panel of the locking device removed. FIG. 13 shows a drive system 950 of the locking device 900 according to at least one embodiment. Drive system 950 includes a motor 952, a gear box 954, a worm gear 956 a cam drive gear 958 and a control printed circuit board (PCB) 960. In this embodiment, a signal generated by the PCB 960 activates the motor 952 to rotate the rotatable locking cam 906. Activation of the motor 952 rotates the worm gear 956 via the gear box 954, which in turn rotates the cam drive gear 958 to rotate the rotatable locking cam 906. A subsequent signal from the PCB can turn off the motor 952. In at least one embodiment, a change in current drawn by motor 952 can be used to detect a position of the locking cam 906. For example, instead of using limit switches to detect a position of the locking cam 906, a spike in the current drawn by motor 952 can be used to detect a hard stop in the rotation of the locking cam 906.

Figure 14:
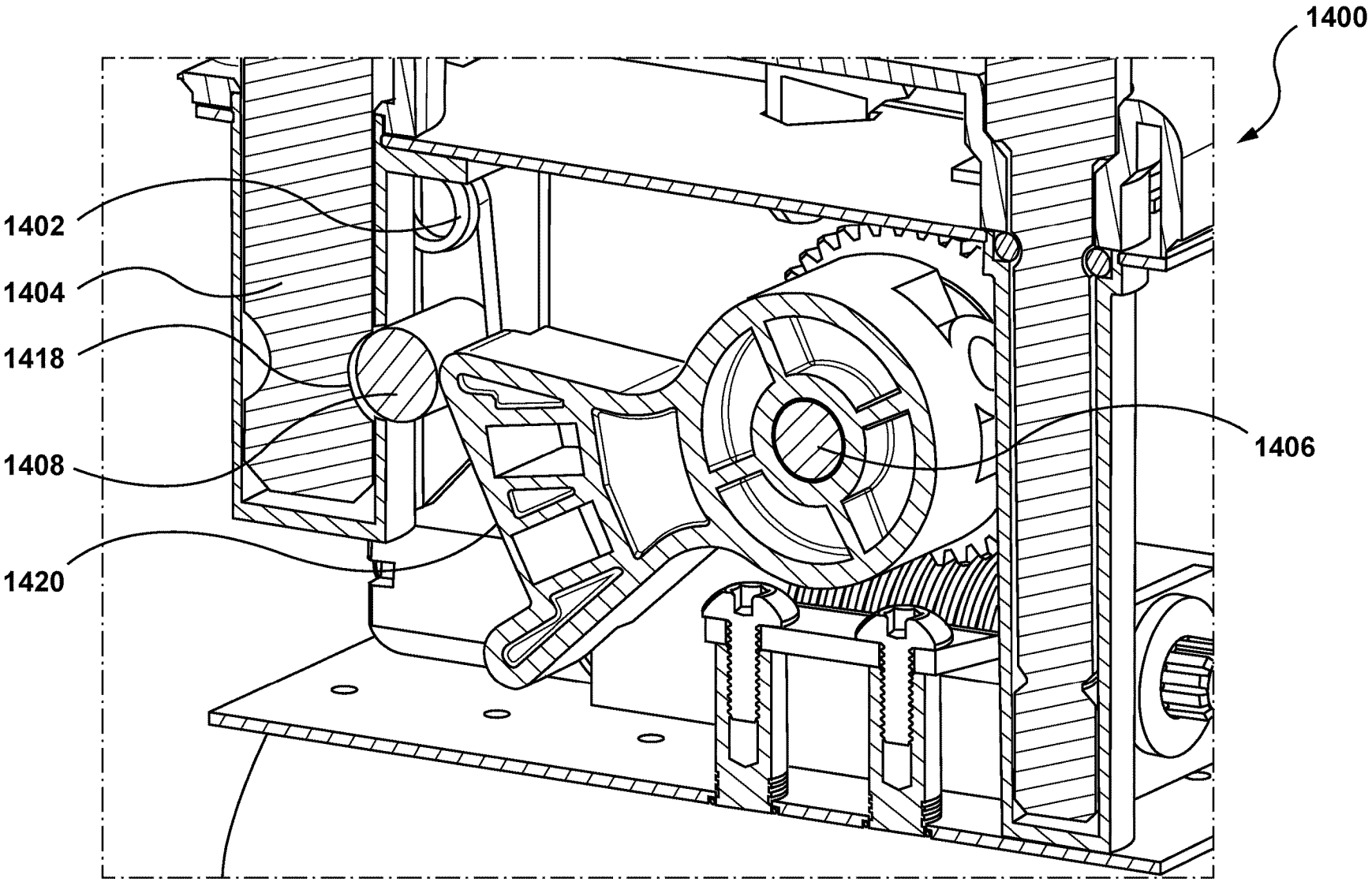
FIG. 14 is a partial perspective view of a locking device is a locked state with a front panel of the locking device removed, according to another embodiment.

In an alternative embodiment, FIG. 14 shows a cross-section view of a portion of a locking device 1400 according to another embodiment. The locking device 1400 includes a torsion spring 1402. Torsion spring 1402 maintains lock pin 1408 tension against a drive surface 1420 of the rotatable cam 1406. As rotatable cam 1406 rotates, torsion spring 1402 biases the lock pin 1408 to disengage with the groove 1418 and move the lock pin to the unlocked position.

Figure 15:
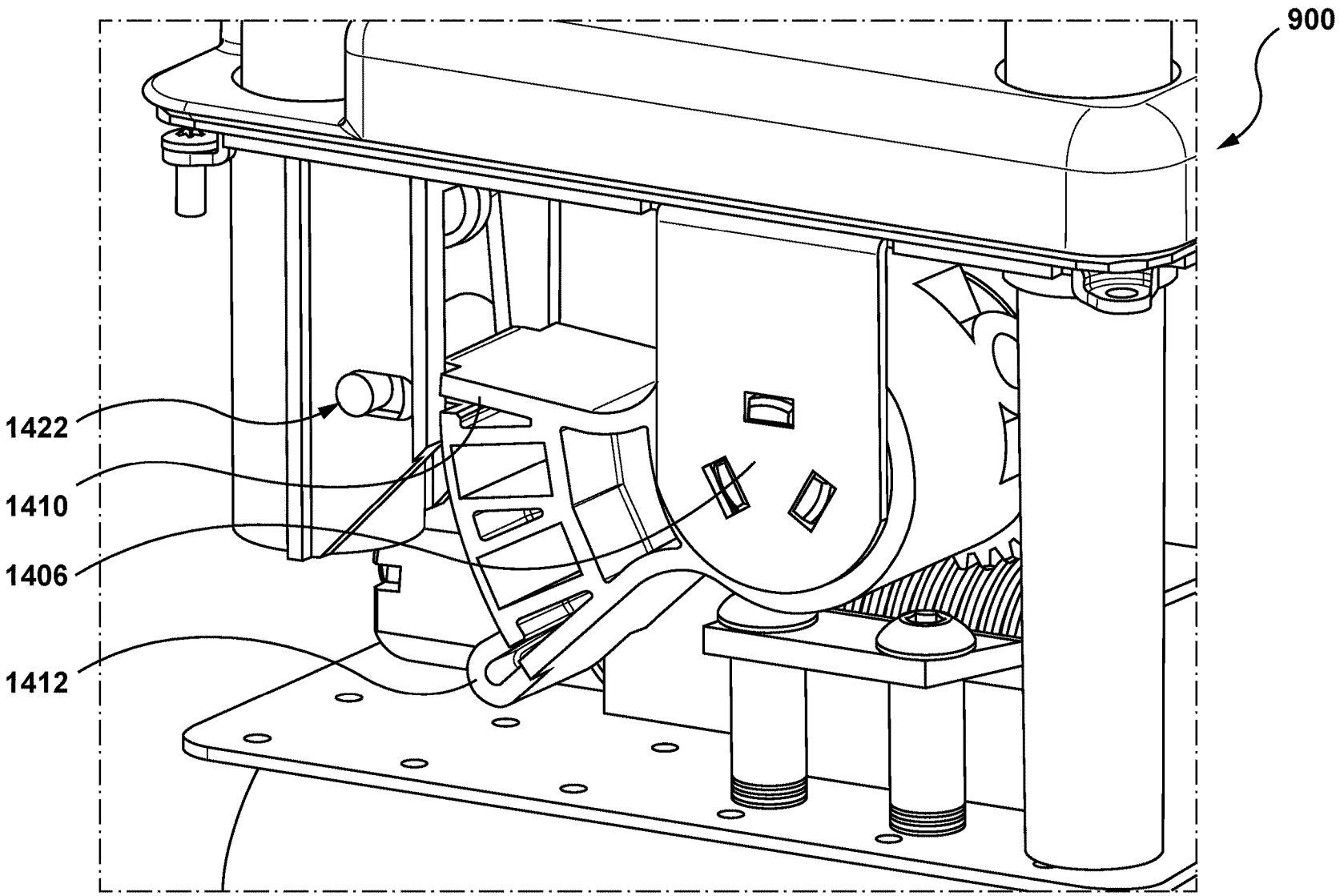
FIG. 15 is a partial rear perspective view of the locking device of FIG. 14.

FIG. 15 is a partial rear perspective view of the locking device of FIG. 14 showing a lock pin cam way 1422. Lock pin cam way 1422 guides lock pin 1408 as lock pin 1408 moves between the locked position where the locking pin 1408 engages with groove 1418 of one of the arms of the shackle 1404 and the unlocked position when the locking pin 1408 disengages the groove 1418 of the one of the arms of the shackle 1404.

Various embodiments have been described herein by way of example only. Various modification and variations may be made to these example embodiments without departing from the spirit and scope of the invention, which is limited only by the appended claims. Also, in the various user interfaces illustrated in the figures, it will be understood that the illustrated user interface text and controls are provided as examples only and are not meant to be limiting. Other suitable user interface elements may be possible.

We claim:

1. A locking device comprising:

a body comprising:

a rotatable locking cam having a locked paddle and an unlocked paddle, the cam being rotatable between a first position and a second position;

a locking pin; and a power supply for supplying electrical power to circuit components of the locking device; and a shackle having two arms configured to be inserted into the body, one of the two arms having a groove in a bottom portion thereof configured to engage with the locking pin when the shackle is in a closed position;

wherein in the first position, the locked paddle of the rotatable locking cam engages the locking pin in the groove and, in the second position, the locked paddle of the rotatable locking cam is disengaged from the locking pin.

2. The locking device of claim 1, wherein each of the unlocked paddle and the locked paddle extend from the rotatable locking cam towards a same arm of the shackle.

3. The locking device of claim 1, wherein the locked paddle is positioned vertically above the unlocked paddle.

4. The locking device of claim 1, wherein the rotatable locking cam is configured to rotate in a first direction to move the locking device from a locked state to an unlocked state and to rotate in a second direction to move the locking device from the unlocked state to the locked state.

5. The locking device of claim 1, wherein the locking pin is biased to disengage with the groove of the shackle upon rotation of the locking cam or free to disengage with the groove of the shackle upon moving the shackle to an unlocked position.

6. The locking device of claim 1, wherein, when the locking device is in a locked state, the locked paddle directly or indirectly engages the locking pin and inhibits the locking pin from disengaging the groove.

7. The locking device of claim 1, wherein, when the locking device is in a partially locked state, the locked paddle is spaced from the locking pin and the locking pin is free to disengage from the groove.

8. The locking device of claim 1, wherein, when the locking device is in a partially locked state, the unlocked paddle is disengaged from the locking pin and the locking pin is free to disengage from the groove.

9. The locking device of claim 7, wherein, when the locking device is in an unlocked state, the locking pin is supported by the unlocked paddle and blocks the movement of the unlocked paddle.

10. The locking device of claim 1, wherein the rotatable locking cam is configured to rotate in a counter-clockwise direction to move from the first position to the second position.

* * * * *